US005462790A

United States Patent [19]

Matsuki et al.

[11] Patent Number: 5,462,790

[45] Date of Patent: Oct. 31, 1995

[54] COMBINED AND MULTI-COMPONENT FALSE-TWIST TEXTURED FILAMENT YARN, PRODUCTION METHOD THEREOF, AND KNITTED/WOVEN FABRIC USING THE YARN

[75] Inventors: Sadao Matsuki; Moriyuki Motogi, both of Ishikawa; Keitaro Nabeshima, Otsu; Minoru Kadowaki, Ibaraki, all of Japan

[73] Assignee: Toray Industries, Inc., Tokyo, Japan

[21] Appl. No.: 307,574

[22] PCT Filed: Dec. 24, 1993

[86] PCT No.: PCT/JP93/01881

§ 371 Date: Sep. 22, 1994

§ 102(e) Date: Sep. 22, 1994

[87] PCT Pub. No.: WO94/18365

PCT Pub. Date: Aug. 18, 1994

[30] Foreign Application Priority Data

| | | | |
|---|---|---|---|
| Feb. 4, 1993 | [JP] | Japan | 5-017404 |
| May 19, 1993 | [JP] | Japan | 5-117257 |
| May 19, 1993 | [JP] | Japan | 5-117258 |

[51] Int. Cl.[6] ..... D03D 3/00

[52] U.S. Cl. ..... 428/229; 8/115.6; 8/922; 57/205; 57/208; 57/247; 57/243; 57/248; 57/287; 57/288; 57/289; 57/290; 428/225; 428/253; 428/397; 428/400

[58] Field of Search ..... 428/225, 229, 428/253, 397, 400, 245; 57/205, 208, 247, 248, 287, 288, 289, 290, 243; 8/115.6, 922

[56] References Cited

FOREIGN PATENT DOCUMENTS

| | | |
|---|---|---|
| 147641 | 12/1976 | Japan . |
| 115135 | 7/1983 | Japan . |
| 136847 | 8/1983 | Japan . |
| 136372 | 9/1985 | Japan . |
| 207638 | 9/1986 | Japan . |
| 133137 | 6/1987 | Japan . |
| 80631 | 3/1990 | Japan . |
| 24241 | 1/1992 | Japan . |
| 316624 | 11/1992 | Japan . |
| 247757 | 9/1993 | Japan . |

*Primary Examiner*—James J. Bell

*Attorney, Agent, or Firm*—Nikaido, Marmelstein, Murray & Oram

[57] ABSTRACT

In a polyester multi-filament yarn consisting of at least two kinds of false twisted filament yarns having different sectional shapes, the present invention relates to a combined and multi-component false twisted filament yarn which comprises at least one kind of filament yarns having a specific sectional shape not having a recess and the other kind of filament yarns having a specific sectional shape having recesses, and wherein the filament yarns having the respective sectional shapes are dispersedly mix-woven. The present invention relates also to a method of producing such a combined and multi-component false twisted multi-filament yarn and a knitted/woven fabric obtained by using such a yarn.

The present invention can provide a combined and multi-component false twisted filament yarn capable of providing a knitted or woven fabric having an excellent drape property and high dry feeling by additional twist within a lower range than the number of twists imparted conventionally to false twisted yarns, also having a puff property, soft feeling and mild, dry and slippery and pliable feeling which are different from hard and hard and sandy feeling obtained conventionally by hard twist, and having high water absorption, and a woven or knitted fabric having water absorption.

18 Claims, 9 Drawing Sheets

COMBINED AND MULTI-COMPONENT FALSE-TWIST TEXTURED FILAMENT YARN, PRODUCTION METHOD THEREOF, AND KNITTED/WOVEN FABRIC USING THE YARN

TECHNICAL FIELD

This invention relates to a combined and multi-component false-twist textured filament yarn constituted by at least two kinds of multi-filament yarns having different sectional shapes and having a slippery and pliable(sara-sara) feeling, a production method of such a yarn, and a knitted/woven fabric having water absorption property.

More particularly, the present invention relates to a combined and multi-component false-twist textured filament yarn suitable for a woven fabric having a slippery and pliable(sara-sara) feeling different from a harsh and stiff-(shari) feeling obtained conventionally by hard twist, and a drape property, to a production method of the yarn, and to a knitted/woven fabric having an excellent drape property and a high water absorption property and equipped with slippery and pliable(sara-sara) touch which restricts a wet and gooey(betotsuki) feeling under a water retention state.

BACKGROUND ART

Conventionally, polyester multi-filament yarns have been used unlike other synthetic fibers such as nylon or acryl because the polyester multi-filament yarns can impart excellent drape property to a woven fabric and can express en elegant silhouette particularly in female dresses.

To impart the drape property, hard twist must be applied to the polyester multi-filament yarn. The yarn is then woven, and the resulting grey goods is subjected to alkali weight loss in a dyeing process and a woven fabric is obtained.

The application of hard twist not only imparts the drape property to a woven fabric but also provides the effects of eliminating a conventional waxy feeling of the woven fabric and imparting a dry and harsh and stiff(shari) feeling. This harsh and stiff(shari) feeling is different depending on the number of hard twists and when the number of twists is excessively great, feeling becomes hard and the woven fabric comes to have an undesirable hard and sandy(jyari) feeling.

When hard twist is applied to the conventional multi-filament yarn so as to impart the drape property or the harsh and stiff feeling, the multi-filament yarns are highly bundled, and the resulting woven fabric comes to have a hard feeling not having a puff property and soft feeling due to the twist structure. To solve this problem, Japanese Patent Publication Nos. 19733/1986, 31210/1986 and 61422/1988 propose a multi-component structure false-twist textured yarn having a core-sheath two-layered structure by compositing at least two kinds of multi-filament yarns having different elongations and drawing and false twisting them.

This structure of the composite structure false twisted finished yarn forms a two-layered structural form having a difference of yarn lengths between core yarns and sheath yarns. In the additional twist process, therefore, a twist yarn tension is first applied to the core yarn side having a smaller yarn length and twist is imparted under a bundled state. As the number of twists further increases, twist is gradually imparted to the group of multi-filaments on the sheath side, and the yarns are twisted around the core yarns. Accordingly, even when the number of twists increases, the multi-filament yarns on the sheath side can form gaps and tend to possess a puff property and a soft feeling.

On the contrary, because the drape property is not sufficient, the woven fabric is not satisfactory. To obtain the drape property or the dry feeling, the number of hard twists must be further increased, so that the drop of the puff property and the soft feeling due to the increase of the number of twists is invited. This problem is remarkable particularly in medium thick woven fabrics using the finished yarns.

As described above, when twisting is effected in the conventional polyester multi-filament yarn or the multi-component structure false-twist textured yarn having the core-sheath two-layered structure so as to obtain the drape property and the dry and harsh and stiff(shari) feeling, the puff property and the soft feeling drop, and when the puff property and the soft feeling are sought, the drape property and the dry feeling drop. it has therefore been difficult to obtain a woven fabric which has the drape property, the dry feeling, the puff property and the soft feeling.

On the other hand, the polyester multi-filament knitted/woven fabric which is recently referred to as the "new synthetic fiber", so called "Shin-Gō-Sen" has a new feeling of good quality which is peculiar to the polyester and cannot be expressed by natural fibers, and when the knitted/woven fabric is touched, the fiber accomplishes a new feeling different from the conventional feeling. However, it involves the problem that when the fiber is put on as a dress, its hygroscopicity and water absorption are by far lower than those of the knitted/woven fabric obtained from the natural fibers.

Though various examinations have been made so as to improve hygroscopicity and water absorption of the synthetic fiber, the synthetic fibers yet involve the problems in comparison with the natural fibers.

In the case of the polyester multi-filament yarns, hygroscopicity has been improved by graft polymerization, mixing of a material having hydrophilicity or copolymerization, and as to water absorption, a method which improves water absorption by utilizing the capillary phenomenon in the aggregate of the multi-filament due to their sectional shapes has been proposed in Japanese Patent Laid-Open No. 122074/1980 besides the technologies described above.

As described above, however, when additional twist is applied to the polyester multi-filament yarn as high level processing means for imparting the new feeling of good quality peculiar to the polyester, protuberances and recesses of the multi-filament yarns having different sectional sections according to the prior art engage with one another as a result of hard twist and the multi-filament yarns are thus packed. Accordingly, the gap structure disappears and the water absorption affect due to the capillary phenomenon cannot be obtained.

Japanese Patent Publication No. 27608/1973, etc, proposes a method which effects spinning after mixing an alkali-soluble material, accomplishes a porous structure by an alkali weight loss of the woven fabric and thus imparts the water absorption property. However, in this case, too, when hard twist is applied, the multi-filament yarns are packed, and water absorption of the gap structure by the capillary phenomenon contributes only to the surface portion of the fiber. Accordingly, water absorption drops remarkably in comparison with the case where twist is not applied. For this reason, the feeling under the water retention state is not free from the wet and gooey(betotsuki) feeling.

Further, in order to impart the water absorption effect, the alkali weight loss is essentially necessary, and the problem of acquisition of water absorption exists in the application for water absorption in the field where additional twist is necessary or in the field where the alkali weight loss is not necessary.

DISCLOSURE OF THE INVENTION

It is an object of the present invention to provide a combined and multi-component false-twist textured yarn which can solve the problems with the prior art described above, can obtain the drape property and the dry feeling by additional twist, and can provide a woven fabric having a puff property and soft feeling different from hard, harsh and stiff(shari) feeling of conventional woven fabrics by hard twist, but has a mild and dry feeling of good quality, slippery and pliable(sara-sara) feeling, and a production method of such a yarn.

It is another object of the present invention to provide a combined and multi-component false-twist textured yarn which scarcely exhibits the drop of the capillary phenomenon due to packing of the multi-filament yarns even under the additional twist state, but has high water absorption, and a knit/woven fabric which has high water absorption, can be pleasantly worn by transferring perspiration from inside the body into and between the filaments when the woven fabric is worn, and can keep the dry, slippery and pliable(sara-sara) feeling even under the water retention state.

To accomplish the objects described above, a first intention according to the present invention comprises the following construction.

In polyester multi-filament yarns consisting of at least two kinds of false-twist textured filament yarns having different sectional shapes, a combined and multi-component false-twist textured filament yarn according to the present invention is characterized in that at least one kind of filament yarn has a sectional shape not having a recess, the other kinds of filament yarns have sectional shapes having recesses, and the filament yarns having the respective sectional shapes are dispersedly mix-woven and have the following characteristics:

$$U\ \% \geqq 0.8 \quad (1)$$

$$\Delta SW\ (\%) \leqq 15 \quad (2)$$

$$CR\ (\%) \leqq 42 \quad (3)$$

$$TR\ (\%) \leqq 20 \quad (4)$$

where:

U % is a uster evenness, ΔSW is a boiling water shrinkage ratio, CR is a crimp rigidity, and TR is a crimp appearance stretch ratio.

Next, a second invention according to the present invention comprises the following construction.

Namely, the second invention provides a method of producing a combined and multi-component false-twist textured filament yarn which comprises mix-weaving and bundling at least two kinds of filament yarns which are obtained by spinning a molten polyester polymer and cooling the spun polymer, at least one kind of which is a filament yarn having a sectional shape not having a recess and the other of which are filament yarns having sectional shapes having recesses, before they are taken up by a take-up roller; taking them up at a take-up rate of not higher than 4,500 m/min to obtain polyester undrawn or semi-drawn yarns; out-drawing the undrawn or semi-drawn yarns at a draw ratio expressed by the following formula (6) at a temperature within the range of 70° to 90° C.; and drawing and false-twist texturing the yarns with a twist coefficient α, defined by the following formula (7), within the range of 24,000 to 35,000 and at a false twist heater temperature of 110° to 190° C., so as to disperse the filament yarns having the respective sectional shapes:

$$0.70 \times NDR \leqq 0.98 \times NDR \quad (6)$$

$$\text{twist coefficient } \alpha = T_2 D^{1/2} \quad (7)$$

where NDR is a natural draw ratio of the polyester undrawn or semi-drawn yarn, R is an out-draw stretch ratio, $T_2$ is the number of false twists (T/M) and D is a total fiber size (Denier) of combined and multi-component false-twist textured filament yarn.

A third invention of the present invention comprises the following construction.

Namely, the third invention provides a knitted/woven fabric obtained from combined and multi-component false-twist textured yarns comprising polyester multi-filament yarns consisting of at least two kinds of false-twist textured filament yarns having different sectional shapes, characterized in that at least one kind of the filament yarns have a sectional shape not having a recess, the other kinds of the filament yarns have sectional shapes having recesses, the filament yarns having the respective sectional shapes are dispersedly mix-woven, a uster evenness (U %) is not smaller than 0.8%, and a twist coefficient α expressed by the following formula is within the range of 2,400 to 14,500:

$$\text{the number of twists } T_1(T/M) = \alpha \cdot D^{-1/2} \quad (8)$$

where:

α: twist coefficient,

D: total fiber size (Denier) of the combined and multi-component false-twist textured filament yarn.

A fourth invention according to the present invention comprises the following construction.

Namely, the fourth invention provides a combined and multi-component false-twist textured filament yarn consisting of at least two kinds of false-twist textured polyester multi-filament yarns having different sectional shapes which are dispersedly mix-woven, characterized in that at least one kind of single filaments have a sectional shape not having a recess, the other kinds of single filaments have a sectional shape having recesses, and when at least one kind of single filaments having a sectional shape not having a recess and at least one kind of single filaments having a sectional shape having recesses come into mutual contact, a gap is defined between the sectional shapes of these single filaments.

A fifth invention according to the present invention comprises the following construction.

Namely, the fifth invention provides a combined and multi-component false-twist textured filament yarn consisting of at least two kinds of false-twist textured polyester multi-filament yarns having different sectional shapes which are dispersedly mix-woven, characterized in that at least one kind of single filaments have a sectional shape not having a recess, the other kinds of single filaments have a sectional shape having recesses, when at least one kind of the single filaments having a sectional shape not having a recess and at least one kind of single filaments having a sectional shape having recesses come into mutual contact, a gap is defined between the sectional shakes of the single filaments, and a uster evenness (U %) is at least 0.8%.

A sixth invention according to the present invention comprises the following construction.

Namely, the sixth invention provides a knitted/woven fabric obtained from a combined and multi-component false-twist textured filament yarn consisting of at least two kinds of false-twist textured polyester multi-filament yarns having different sectional shape which are dispersedly mix-woven, characterized in that at least one kind of single filaments have a sectional shape not having a recess and the other kind of single filaments have a sectional shape having recesses, when at least one kind of the single filaments having a sectional shape not having recess and at least one kind of single filaments having a sectional shape having recesses come into mutual contact, a gap is defined between the sectional shapes of the single filaments, and a twist coefficient α, defined by the following formula, is within the range of 2,400 to 14,500:

$$\text{the number of twists } T_1(T/M)=\alpha\cdot D^{-1/2} \quad (10)$$

where:

α: twist coefficient,

D: total fiber size (Denier) of combined and multi-component false-twist textured yarn.

Further, a seventh invention according to the present invention comprises the following construction.

The seventh invention provides a knitted/woven fabric obtained from a combined and multi-component false-twist textured filament yarn consisting of at least two kinds of false-twist textured polyester multi-filament yarns having different sectional shapes which are dispersedly mix-woven, characterized in that at least one kind of single filaments have a sectional shape not having a recess and the other kind of said single filaments have a sectional shape having recesses, when at least one kind of the single filament having a sectional shape not having a recess and at least one kind of the single filaments having a sectional shape having recesses come into mutual contact, a gap is defined between the sectional shapes of these single filaments, a uster evenness (U %) is at least 0.8%, and a twist coefficient α, defined by the following formula, is within the range of 2,400 to 14,500:

$$\text{the number of twists } T_1(T/M)=\alpha\cdot D^{-1/2} \quad (11)$$

where:

α: twist coefficient,

D: total fiber size (Denier) of combined and multi-component filament yarn.

According to the present invention, the drape property and the dry feeling can be obtained by additional twist. The present invention can provide a combined and multi-component false-twist textured filament yarn capable of providing a woven fabric having a puff property and soft feeling different from the hard and harsh and stiff feeling of conventional woven fabrics obtained by hard twist, but having mild, dry, massive and slippery and pliable feeling, and the woven fabric or knitted fabric obtained from the yarn.

According to the present invention, an excellent drape property and a dry feeling can be obtained by additional twist in a lower range than the number of twists applied to conventional false-twist textured finished yarns. The present invention can provide a combined and multi-component false-twist textured yarn capable of providing a woven fabric or knitted fabric having a puff property, soft feeling, mild, massive and slippery and pliable feeling different from the hard and harsh and stiff feeling of conventional woven fabrics obtained by hard twist, but having at the same time excellent water absorption, and a woven fabric or knitted fabric having excellent water absorption.

BEST MODE FOR CARRYING OUT THE INVENTION

Hereinafter, the first to seventh inventions of the present invention will be sequentially explained in detail.

First, a combined and multi-component false twist filament yarn according to the present invention will be explained. The characterizing feature of the combined multi-component false twist yarn according to the present invention resides in the sectional shape of a multi-filament yarn and the structure of its multi-component state, and drape property and dry feeling can be obtained by additional twisting having the number of twists of below a conventional hard twist range. Another novel effect is that peculiar slippery and pliable feeling as mild and dry feeling of mass can be obtained.

The combined and multi-component false twist filament yarn according to the present invention is a multi-filament yarn obtained by making filament yarns having different sectional shapes composite with one another. The number of kinds of sectional shapes is at least two. It is hereby important that at least one kind of filament yarn consists of a filament yarn having a sectional shape which does not have a recess, and the other filament yarns consist of filament yarns having sectional shapes which have a recess or recesses.

FIGS. 1 to 10 are explanatory views useful for explaining the fiber sectional shape.

The explanation will be given in further detail with reference to the drawings. The term "sectional shape not having recess" in the present invention fundamentally represents those sectional shapes which do not have a plurality of contact points when tangents coming into contact with the sectional profile are drawn on the same section, and includes also those sectional shapes which are partially recessed due to contact with adjacent yarns, etc, at the time of false-twist texturing even though the raw yarns do not have the recess (the sectional shape not having a plurality of contact points).

Figure 1:
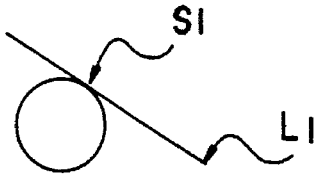
FIGS. 1 to 10 are explanatory views for explaining fiber sectional shapes.
Figure 2:
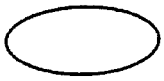

Concrete examples of the sectional shapes not having the recess are a round shape (FIG. 1), an elliptic shape (FIG. 2), tri- or polygonal shapes having a relative roundness at corners (FIGS. 3, 4), and so forth. As shown in FIG. 1, when a tangent ($L_1$) is drawn, a plurality of contact points do not exist but only one contact point ($S_1$) exists for these sectional shapes.

Figure 5:
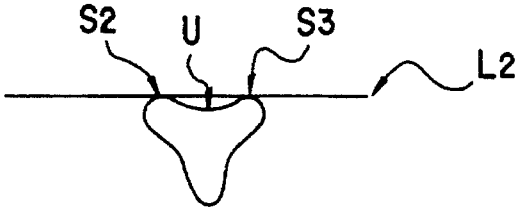
Figure 6:
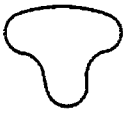
Figure 7:
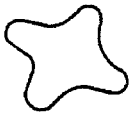
Figure 8:
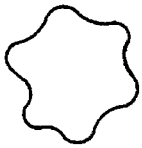
Figure 9:
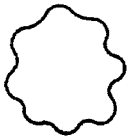

On the other hand, sectional shapes having a recess or recesses will be explained with reference to FIG. 5. When a tangent ($L_2$) coming into contact with the sectional profile is drawn on the same section, the sectional shapes have a plurality of contact points ($S_2$, $S_3$), a recess (U) is defined between these contact points, and a protuberance is defined between the adjacent recesses.

Figure 10:
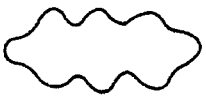

In the present invention, the sectional shape having the recess may be symmetric or asymmetric, and the invention is not particularly limited by the size of such a recess. Definite examples of such a sectional shape are a Y type (FIG. 5), a T type (FIG. 6), a four-lobed type (FIG. 7), a six-lobed type (FIG. 8), an eight-lobed type (FIG. 9) and a comb-type (FIG. 10). A tangent having a plurality of contact points when the tangent is drawn as shown in FIG. 5 exists for each of these sectional shapes.

Figure 11:
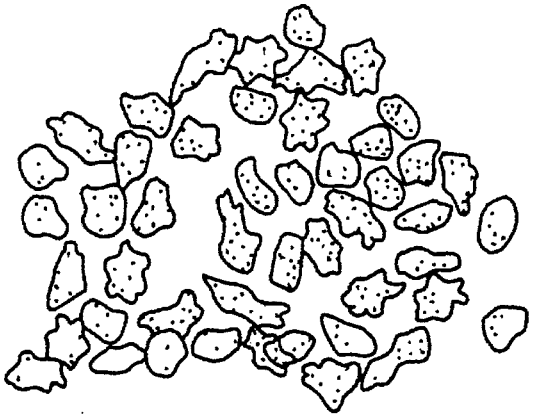
FIG. 11 is a sectional view (dense dyed portion) showing an example of a combined and multi-component false-twist textured filament yarn according to the present invention.
Figure 12:
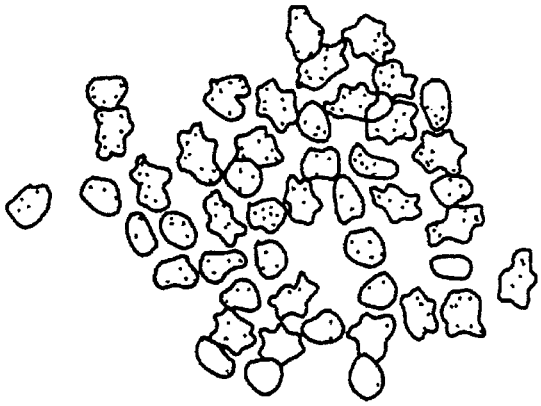
FIG. 12 is a sectional view (light dyed portion) showing an example of the combined and multi-component false-twist textured filament yarn according to the present invention.

FIGS. 11 and 12 are sectional views each showing an example of the combined and multi-component false twist filament yarn according to the present invention.

Figure 13:
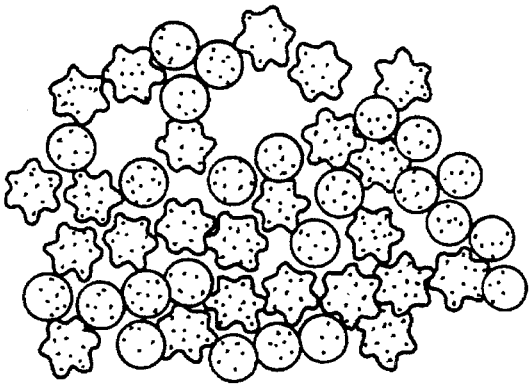
FIG. 13 is a sectional view showing an example of a raw yarn for obtaining the combined and multi-component false twisted filament yarn according to the present invention.

FIGS. 11 and 12 show the multi-component yarns obtained by false-twist texturing the raw yarns (FIG. 13), in which the filament yarns having the circular (round) section and those having the six-lobed section are uniformly dispersed and arranged. However, FIG. 11 shows the section of a dense dyed portion in which the later-appearing thick portions primarily exist, and FIG. 12 shows the section of a light dyed portion in which the later-appearing thin portions primarily exist. Incidentally, dots inside the fiber section represent the existence of titanium oxide.

Because the combined and multi-component false twist filament yarn can be obtained by false-twist texturing as will be later described, the section in which the sectional shape does not have the recess in the raw filament yarn and the section in which the sectional shape have the recess can be clearly distinguished. However, because the section changes as a result of false-twist texturing as shown in FIG. 11 or 12, there is the case in the combinated and multi-component false twist filament yarn according to the present invention where the section does not have the recess in the raw yarn form but comes to have partial recesses, or the case where the portion which is the recess in the raw filament yarn disappears due to the change of the section.

Because the protuberance defined by the sectional shape having the recesses (the protrusive portion defined between the recesses) exists in the combined and multi-component false twist filament yarn according to the present invention, when additional twist is applied to the combined and multi-component false twist filament yarn, the surface concavoconvexities of the multi-filament, which are different from the concavoconvexities of the surface resulting from the twist structure due to additional twist, produce slippery and pliable feeling, and thus generate a novel feeling in combination with sliminess produced by the sectional filament yarns not having the recesses.

To obtain the slippery and pliable feeling as the feeling of the woven fabric, the number of recesses in the sectional shape having the recesses is preferably 2 to 20, and particularly preferably, from 3 to 8.

In the present invention, the mixing ratio of the filament yarns having the sectional shape having the recesses to the filament yarns having the sectional shape not having the recesses is preferably from 20:80 to 80:20 and further preferably, from 40:60 to 60:40, from the aspect of the effect of the concavoconvexities of the sectional shape.

Next, as to the combination state between the filament yarn having the sectional shape having the recesses and the filament yarn having the sectional shape not having the recesses, it is important that the filament yarns of the respective sectional shapes be dispersed and woven in combination in the outer and inner layers under a random state.

Figure 14:
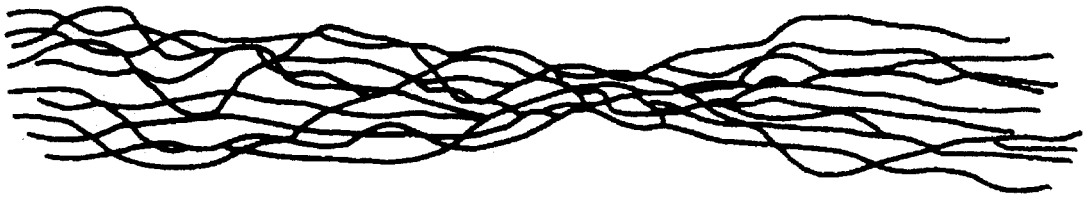
FIG. 14 is a schematic side view showing an example of the combined and multi-component false-twist textured filament yarn according to the present invention.

FIG. 14 is a schematic side view showing an example of the combined and multi-component false twist filament yarn according to the present invention, wherein entanglement is applied by an interlace nozzle.

Figure 15:
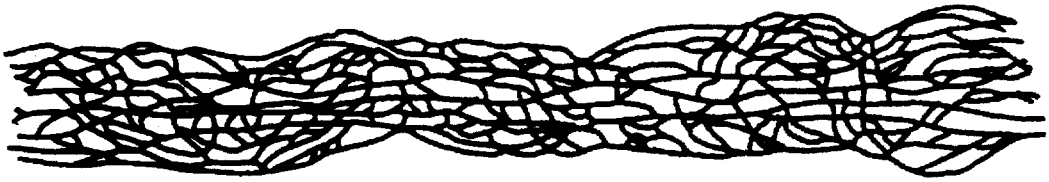
FIG. 15 is a schematic side view showing a conventional alternate twist core-sheath two-layered structure yarn.
Figure 16:
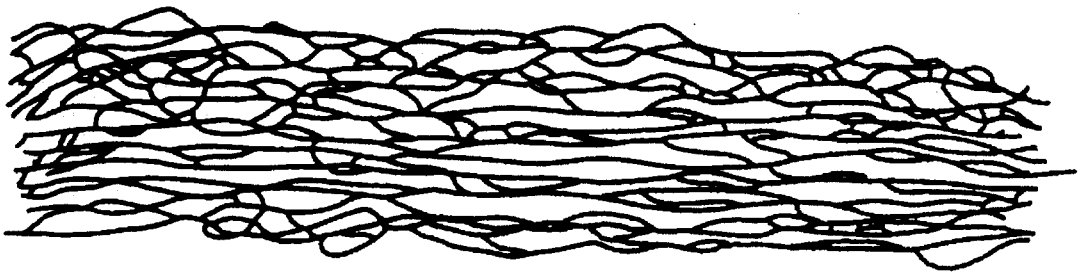
FIG. 16 is a schematic side view showing a conventional core-sheath multi-layered structure yarn.

On the other hand, FIG. 15 is a schematic side view showing an alternate twist core-sheath two-layered structural filament yarn according to the prior art, and FIG. 16 is a schematic side view showing a core-sheath multi-layered structural filament yarn according to the prior art. FIGS. 15 and 16 show the two-layered structural form consisting of the core filament yarns represented by thick lines and sheath filament yarns represented by thin lines.

In the combined and multi-component false-twist textured filament yarn according to the present invention, the yarns having the respective sectional shapes are dispersed at random in the outer and inner layers as shown in FIG. 14 or 11 (FIG. 12). Therefore, when additional twist is applied, the respective sectional shapes are dispersed and arranged on the yarn surface, so that the slippery and pliable feeling due to the combination effect brought forth by the harmony of the section having the recesses and the section not having the recess can be obtained. Further, because the filament yarns having the sectional shape having the recesses and the filament yarns having the sectional shape not having the recess are dispersed at random, engagement between the recesses is not likely to occurs when the number of additional twist is increased. Accordingly, the drop of bulkiness can be prevented and the puff feeling can be maintained.

In the case of the multi-component filament yarn having the core-sheath two-layered structure constituted by the aggregate of the filament yarns having the respective sectional shapes, the slippery and pliable feeling due to the harmonized composite effect cannot be obtained.

The present invention uses the filament yarn consisting of a polyester polymer, preferably a copolymerized polyethylene terephthalate containing at least 85 mol % of a polyethylene terephthalate or ethylene terephthalate unit. The filament yarns having the respective sectional shapes may be constituted by separate kinds of polymers. The polyester constituting the filament yarns may contain other additives such as a delustering agent, e.g. titanium oxide, a pigment, a light-proofing agent, a flame retardant, and so forth.

The relationship between the single yarn size D1 of the filament yarn having the sectional shape not having the recess and the single yarn size D2 of the filament yarn having the sectional shape having the recess preferably satisfy the relation $0.5 \leqq D2/D1$ from the aspect of the sliminess effect to the feeling brought forth by the filament yarn having the sectional shape not having the recess, and preferably satisfies the relation $D2/D1 \leqq 2.0$ from the aspect of the feeling effect brought forth by the filament yarn having the sectional shape having the recesses. Further, both of D1 and D2 are preferably not greater than 10 Deniers.

It is important that the boiling water shrinkage ratio of the combined and multi-component false twist filament yarn is not greater than 15% when measured in accordance with JIS L1090A (hank shrinkage ratio) as the combined and multi-component false twist filament yarn. From the aspect of the effect brought forth by the sectional shape having the recess, the boiling water shrinkage ratio SW1 of the filament yarn having the sectional shape not having the recesses and the boiling water shrinkage ratio S2 of the filament yarn having the sectional shape having the recesses preferably satisfy the relation $SW1-SW2 \leqq 8\%$ and more preferably, $SW1-SW2 \leqq 5\%$.

When undrawn filament yarns or semi-drawn filament yarns are subjected to out-drawing and draw/false twist processings, thick-and-thin portions are imparted to the multi-filament yarn, so that puffness, drape property, slippery and pliable feeling, etc, are imparted to the woven fabric.

Further, when the multi-filament having the sectional shape having the recess and the multi-filament having the sectional shape not having the recess are simultaneously spun, a difference of birefringence occurs between these multi-filaments and similarly, a difference of birefringence occurs between thick portions and thin portions of the thick-and-thin portions of each multi-filament yarn generated by out-draw. These differences together generate a difference of shrinkage ratios.

It is believed that this difference of shrinkage ratios is dispersed at random by combination-weaving due to single yarn migration at the time of draw/false twist processing and interlace processing, inside the yarn section, appears as the difference of shrinkage inside and between the filaments during additional twist of the combination-woven yarns and during the dyeing process of the resulting woven fabric, and greatly contributes to the puff property, the drap property and smooth feel due to the decrease of the contact areas between the multifilaments.

This thick-and-thin property is measured by uster evenness U %, and it is important that this U % value be at least 0.8%. If it is less than 0.8%, the difference of shrinkage ratios between, and inside, the single yarns is small and contribution particularly to the puff property becomes small, though it is associated with the boiling water shrinkage ratio. A particularly preferred range is from 1.0 to 3.0%.

The thick portion of the multi-component combination-woven yarn has relatively low birefringence but relatively great amorphous portions. Therefore, it has relatively high dyeability and forms a dense dyed portion (FIG. 11). On the other hand, the thin portion has relatively high birefringence but relatively small amorphous portions. Therefore, it has relatively low dyeability, and forms light dyed portions (FIG. 12).

In the combined and multi-component false twist yarn, a crimp rigidity CR as crimp characteristics imparted by false twist processing and a crimp appearance stretch ratio TR in heat treatment under the application of a load are important. The CR value which contributes to the puff property, particularly to the drape property, of the woven fabric must be not greater than 42%, and the TR value in this case must be not greater than 20%. Further preferably, CR and TR are not greater than 35% and 5%, respectively.

The woven fabric obtained by using the combined and multi-component false twist filament yarn has the excellent drape property which is different from that of the woven fabric obtained by using the multi-component structure false twist yarn having the core-sheath two-layered structure according to the prior art, and can provide a woven fabric having novel slippery and pliable feeling effect.

Next, a method of producing a combined and multi-component false twist filament yarn according to the second invention of the present invention will be explained.

The combined and multi-component false twist filament yarn according to the present invention can be obtained by first obtaining a polyester undrawn yarn or semi-drawn yarn in which filament yarns having the sectional shape having the recesses and the filament yarns having the sectional shape not having the recess are combined and woven, and then applying draw/false twist processing. What is hereby important is that the filament yarns are combined, woven and bundled before being taken up by a take-up roller of a spinning process so as to obtain the polyester undrawn yarn or drawn yarn in which the filament yarns having mutually different sectional shapes are mix-textured. More concretely, it can be obtained by the process steps shown in FIGS. 17 to 19.

Figure 17:
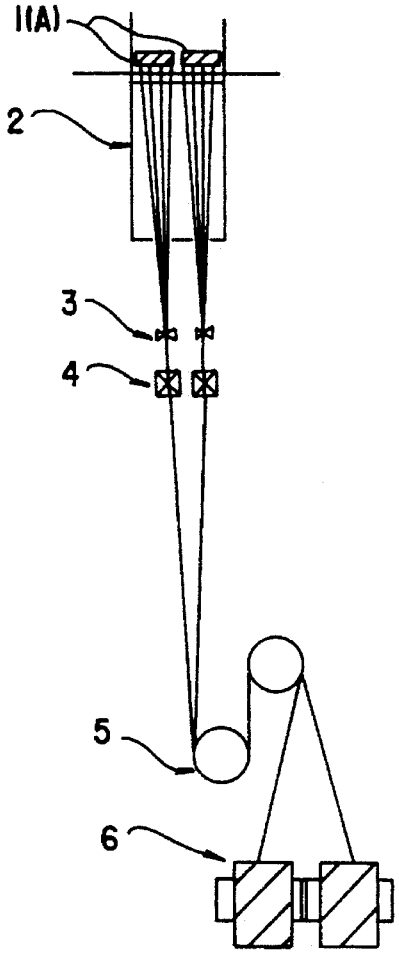
FIG. 17 is a schematic process view showing an example of a method of obtaining the combined and multi-component false-twist textured filament yarn according to the present invention.
Figure 18:
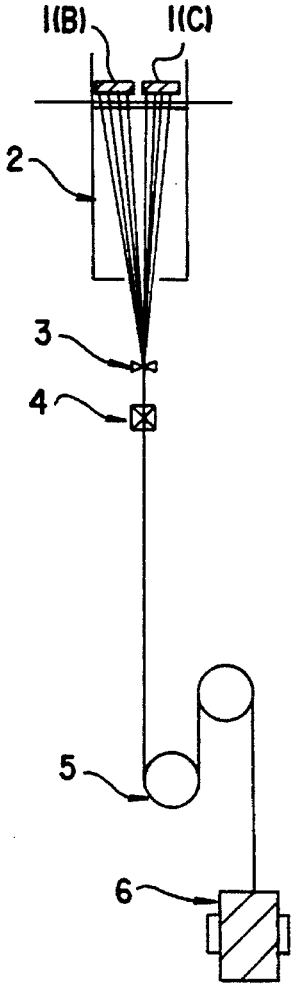
FIG. 18 is a schematic process view showing another example of a method of obtaining the combined and multi-component false twist filament yarn according to the present invention.
Figure 19:
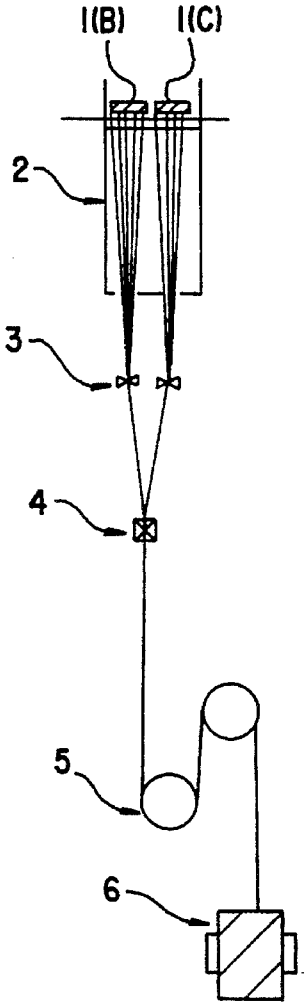
FIG. 19 is a schematic process view showing still another example of a method of obtaining the combined and multi-component false-twist textured filament yarn according to the present invention.

FIGS. 17 to 19 are schematic process views showing methods of obtaining the combined and multi-component false twist filament yarns according to the present invention, respectively. In the drawings, reference numeral 1 denotes a die, 2 is a chimney, 3 is an oil feed guide, 4 is an interlace nozzle, 5 is a take-up roller, and 6 is a package.

FIG. 17 shows a method which bundles yarns spun out from one die (A) consisting of at least two different kinds of spinnerets, wherein at least one kind has the shape not having the recess and the other shapes have the recess, then applies an oil, combines and bundles the yarns, and takes them up by the take-up roller.

FIG. 18 shows a method which bundles the yarns spun from one die (B) consisting of a spinneret having the shape which does not have the recess and from one die (C) consisting of a spinneret having the shape which has the recess, feeds an oil to the yarns so bundled, combines and bundles them, and takes them up by the take-up roller.

Further, FIG. 19 shows the method which bundles the yarns spun out from one die (B) consisting of a spinneret having the shape not having the recess and from one die (C) having the shape having the recess, feeds an oil to them, combines and bundles them by the interlace nozzle, and takes them up by the take-up roller.

Among them, preferred particularly is the method which spins a molten polyester polymer from one die consisting of at least one kind of spinneret having the shape not having the recess and at least two kinds of spinnerets having different shapes which have the recess, from the aspects of a combination-weaving state of each constituent filament and productivity.

Examples of one die consisting of at least two kinds of spinnerets having the different shapes, which are used for the present invention, include the die which is concentrically perforated (FIG. 20), the dies having a group arrangement (FIGS. 21, 22), the dies having a grid-like arrangement (FIGS. 23, 24), etc, as shown in FIGS. 20 to 24. Incidentally, circle ○ represents the spinneret having the shape which does not have the recess, and symbol X represents the spinneret having the shape which has the recess.

On the other hand, according to the method which spins filament yarns having the recess and takes them up at one of their ends, separately spins filament yarns not having the recess and takes them up at one of their ends, paralles these filament yarns together, conducts combination weaving, and draws and false twists the resulting polyester undrawn yarn or semi-drawn yarn, the combination weaving state cannot be distributed so easily and at random between the outer and inner layers.

From the aspect of the improvement in productivity, a method which takes up a plurality of filament yarns from one die can be preferably employed.

When the polyester undrawn yarn or semi-drawn yarn obtained in the way described above are drawn and false twisted, a combined and multi-component false twist yarn in which each individual yarn is dispersed at random from the outer layer to the inner layer without causing the filament yarns having each sectional shape to substantially constitute a core-sheath two-layered structure.

Next, the drawing and false-twist texturing conditions will be explained.

Figure 25:
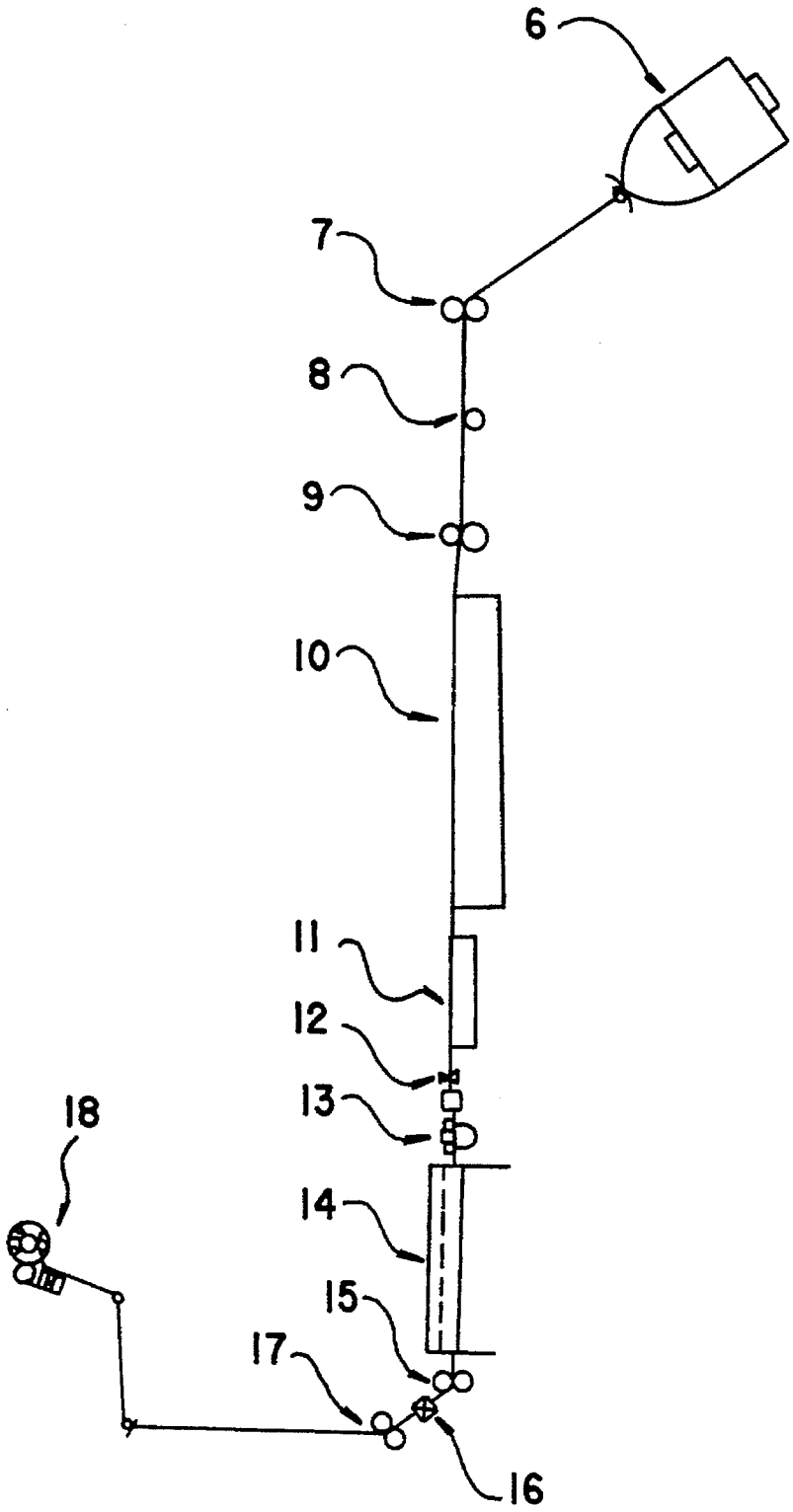
FIG. 25 is a schematic process view showing an example of a draw and false-twist texturing method in the production method of the combined and multi-component false-twist textured filament yarn according to the present invention.

FIG. 25 is a schematic process view showing an example of a drawing and false-twist texturing method in the production method of the combined and multi-component false twist yarn according to the present invention. In this drawing, reference numeral 6 denotes a package, 7 is a feed roller for out-draw, 8 is a hot pin, 9 is a first feed roller, 10 is a first heater, 11 is an air cooling plate, 12 is a twister, 13 is a second feed roller, and 14 is a second heater.

Out-draw is applied in advance to the polyester undrawn yarn or semi-drawn yarn obtained by the method described above while being heat-treated through the hot pin 8 set between the rollers, before the drawing and false-twist texturing is conducted.

The out-draw condition is as follows. While pre-heating is being carried out at a temperature within the range of 70° to 90° C. by using the hot pin or the hot rollers, drawing is effected within the following range in accordance with a natural draw ratio (NDR) of the polyester undrawn yarn or semi-drawn yarn:

$$0.70 \times NDR \leqq R \leqq 0.98 \times NDR$$

Here, NDR is the natural draw ratio of the polyester undrawn yarn or semi-drawn yarn, and R is an out-draw ratio.

It is important that the drawing and false- twist texturing process be carried out in succession to out-draw at a heater temperature in the range of 110° to 190° C. so that the number of false twists $T_2$ (T/m) satisfies the relation of a twist coefficient $\alpha$= 24,000 to 35,000 with respect to the denier D after processing.

If the heater temperature is less than 110° C., the heat set region at the time of the drawing and false-twist texturing process becomes extremely unstable and this region is difficult to control from the aspect of production technologies to obtain the boiling water shrinkage ratio of not higher than 15%. If the heater temperature exceeds 190° C., on the other hand, the boiling water shrinkage ratio of at least 6%, which contributes to the puff property, cannot be obtained.

If the twist coefficient $\alpha$ is less than 24,000 at the time of the false-twist texturing process, the shape of the multi-filament yarn approaches to that of the raw yarns particularly in the region having a low false-twist texturing temperature, and the puff property becomes inferior to that of the false twist two-layered structural yarn according to the prior art. If the twist coefficient $\alpha$ exceeds 35,000, crimps become greater in the region having a high false-twist texturing temperature in the same way as in the conventional false twist yarns, and hard and sandy feeling due to the crimp characteristics occurs in the feeling of the woven fabric.

Preferably, the boiling water shrinkage ratio SW (%) be not greater than 15%, the crimp rigidity CR (%) among the crimp characteristics be not greater than 42% and the crimp appearance stretch ratio TR (%) by the heat-treatment under load be not greater than 20% as the yarn properties of the multi-filament yarn obtained by the drawing and false- twist texturing processing. For, when a woven fabric is obtained by additionally twisting and weaving the combined and multi-component false twist yarns and then dyeing the woven fabric, the yarn properties described above greatly contribute to the slippery and pliable feeling and the high drape property. Further preferably, SW (%) is from 6 to 15%, CR (%) is not greater than 35%, and TR (%) is not greater than 5%.

Here, the boiling water shrinkage ratio SW (%) and the crimp rigidity CR (%) are determined in accordance with JIS L1090 (Testing Method of Synthetic Fiber Multi-Filament Bulky Processed Yarns). Incidentally, SW (%) is determined by the Boiling Water Shrinkage Ratio A Method (Hank Shrinkage Ratio).

The crimp appearance stretch ratio TR (%) by the heat-treatment under load is determined by the following method.

A hank is produced by winding five times the multi-component yarn, an initial load having an apparent size of 0.02×D (g) (D: Denier of the multi-component yarn) is applied, dry heat-treatment is carried out at 150°±2° C. for 5 minutes, and a constant load of an apparent size of 0.1×D is applied (g) so as to calculate the length ratio.

$$TR\ (\%)=100\times(l_1-l_2)/l_2$$

where $l_1$: hank length when constant load is applied, $l_2$: hank length when initial load is applied and dry heat-treatment is made.

The reason why the combined and multi-component false twist filament yarn, wherein each yarn is dispersed from the outer layer to the inner layer under a relatively random state while the filament yarn having each sectional shape does not substantially form the core-sheath two-layered structure, can be produced according to the production method of the present invention is believed as follows. First, the filament yarn having the sectional shape equipped with the recess and the filament yarn having the sectional shape without the recess provide the difference of shapes. Therefore, the yarns having the difference of degree of orientation can be obtained between the filament yarns having different sectional shapes due to the differences of cooling rates and spinning tensions in the spinning process, and when such filament yarns are drawn and false-twist textured, the difference of the drawing tensions occurs between the filament yarns having the different sectional shapes, so that the false twist processed yarns which are dispersed from the outer layer to the inner layer under the random state and are combination-woven can be obtained. It is further believed that because the resulting false twist processed yarns exhibit different shrinkage behaviours between the filament yarns having different sectional shapes at the time of hot water treatment, they provide the puff property.

Because the out-draw treatment is executed before false-twist texturing, this treatment is believed to provide the following effects.

In has been known in the past that variation processing is effected by drawing an undrawn yarn or a semi-drawn yarn in the natural draw ratio zone of high draw characteristics which the raw yarn has, while the yarn is being heated. In the present invention, this variation processing is executed for the composite undrawn yarn or semi-drawn yarn obtained as described above and furthermore, when drawing and false-twist texturing are carried out in an indraw false twist zone in succession to the variation processing, the portions of a low orientation formed as a result of out-draw are heated and drawn, but portions of a high orientation are more difficult to be drawn than the low orientation portion. Accordingly, migration takes place in a very small region of the multi-filament yarn constituting the multi-component yarn, and the combination-weaving effect of the multi-filaments can be improved. Due to the difference of orientation resulting from the thick-and-thin effect, the difference of heat shrinkage is imparted to the yarn in the longitudinal direction, and when heat-treatment is carried out at the dyeing step after the woven fabric structure is obtained, gaps are defined between the yarns in the longitudinal direction and contribute to the puff property.

Particularly in the case of this combined and multi-component multi-filament yarn, the degree of orientation is greater in the multi-filament yarn having the recess than in the multi-filament yarn not having the recess due to the difference of the cooling rates at the time of spinning and the difference of the tensions. When variation occurs in the longitudinal direction of the respective multi-filament yarns due to drawing in the natural draw ratio zone, the degree of orientation occurs between the thick-and-thin portions of the multi-filament yarn having the recess and those of the multi-filament yarn not having the recess. When the multi-filament yarns having such a difference of the degrees of orientation are drawn and false-twist textured, random migration between the multi-filament yarns is further promoted due to drawing of the thick-and-thin portions of the multi-filament yarns having the respective sectional shapes.

It is further effective in the production process of the combined and multi-component false twist filament yarn according to the present invention to impart entanglement between the single yarns by the interlace nozzle after drawing and false-twist texturing are carried out but before take-up. When entanglement is imparted between the single yarns, the combination weaving effect can be improved between the multi-filament yarns having the sectional shape having the recess and the multi-filament yarns having the sectional shape without the recess because this combined and multi-component false twist yarn does not have the core-sheath two-layered structure. In this case, migration takes place, too, and the effect of the present invention can be improved preferably. Furthermore, application of entanglement provides also the effect of improving the pass property of the combined and multi-component false twist filament yarn in the post-treatment steps. The degree of entanglement is preferably at least 10 pcs/m.

Next, a knitted/woven fabric according to the third invention of the present invention will be explained.

A woven fabric or knitted fabric having a novel feeling can be obtained by weaving the combined and multi-component filament yarns of the invention described above for both warps and wefts or for either the warps or wefts, or knitting them.

When the combined and multi-component false twist filament yarns are woven as both warps and wefts, the effect of the filament yarns having the sectional shape with the recess and the filament yarns having the sectional shape without the recess can be effectively expressed without any limitation, in particular, but when they are used for only the warps, it is preferred to use, as the wefts, those polyester multi-filament yarns which are obtained by increasing the number of additional twists to ordinary polyester multi-filament yarns used for ordinary fabrics.

When additional twist is suitably applied to the combined and multi-component false twist filament yarn consisting of the multi-filament yarn having the sectional shape with the recesses and the multi-filament yarn having the sectional shape without the recess, a woven fabric which has a further improved drape property, a slippery and pliable feeling which is different from a dry and harsh and stiff feeling of the conventional hard twist woven fabric and a novel feeling can be obtained.

In the conventional hard twist woven fabrics of the polyester multi-filaments according to the prior art, the number of additional twists of 1,500 T to 2,300 T/M has been generally used for the size corresponding to 150 Denier, but in the combined and multi-component false twist filament yarn of the present invention, the number of additional twists is sufficiently up to 1,500 T/M. When it exceeds 1,500 M/T, the feeling effect of the sectional shape having the recess becomes great, and the feeling becomes generally an undesirable hard and hard and sandy feeling.

In connection with the relation with the Denier to be employed, it is important that the range of the number of additional twists of the combined and multi-component false twist filament yarn according to the present invention is such that the twist coefficient α defined by the following formula satisfies the relation:

$$T_1(T/M)=\alpha\cdot D^{-1/2}$$

$$2{,}400\leqq\alpha\leqq14{,}500$$

When $T_1$ is within the range of $2{,}400\leqq\alpha\leqq10{,}000$, a further novel feeling effect can be obtained by effecting mix-weaving the combined and multi-component false twist filament yarn of the present invention as the warps and the yarns obtained by applying hard twist to the polyester multi-filament yarns that has been generally used in the past for hard twist woven fabrics, as the wefts.

Next, the method of obtaining the woven fabric having a novel slippery and pliable feeling effect according to the present invention, which is different from the conventional dry and harsh and stiff feeling, in the additional twist region of the conventional hard twist woven fabrics will be explained.

In the twisting process, ordinary twisting machines such as an Italy type, a doubler/twister type, a double-twister type, etc, can be used without any limitation, but in order to obtain the smooth and dry feeling and to rationally produce the product, the double-twister type is used most preferably.

In conjunction with the occurrence of kinky threads due to the generation of the residual torque of the twist yarns, it is commonly known that the kinky threads are small because they greatly depend on the pass property in the warping process. Therefore, twist setting is generally carried out by steam, etc, after additional twisting. In the present invention, however, twist setting is preferably avoided or is preferably carried out at a temperature as low as possible so that shrinkage of processing is allowed to exhibit as great as possible by the relax heat-treatment in the dyeing processing of the woven fabric and to impart the puff property in the additional twist yarns of the combined and multi-component false twist filament yarn of the present invention. More concretely, in the case of additional twist in a direction which offsets the torque, twist setting is not necessary for the number of additional twists of up to about 800 T/M and up to about 600 T/M in an opposite direction, though the value is different depending on the forward/reverse additional twist direction with respect to the direction of the residual torque of the combined and multi-component false twist filament yarn of the present invention.

Next, as to sizing in the warping process, weaving can be made without sizing by executing additional twist, trough it depends on the standard such as a density, and a woven fabric having excellent puff property and slippery and pliable feeling can be obtained. Ordinary looms, water jet looms, rapier looms, etc, can be used for weaving without any limitation.

The resulting grey goods is subjected to the dyeing process, and eventually, a product having an excellent feeling can be obtained. The process may sufficiently comprise a sequence of wet heat relax, intermediate set (dry heating), alkaline weight loss, dyeing and finish set, as has been carried out ordinarily.

In the process described above, wet heat relax has the operation of imparting the puff property and the surface feeling to the woven fabric. The number of additional twist of the combined and multi-component false twist filament yarn described above is within a lower range than the ordinary range. To obtain sufficient fiber shrinkage ratio and sufficient untwisting effect of the twist yarn, a relax processing by a liquid flow system is preferred and a treating temperature is preferably from 90° to 130° C. The alkali weight loss processing is an important processing in order to impart the drape property and the slippery and pliable feeling. The combined composite processed yarn described above has the thick-and-thin effect in the longitudinal direction of the multi-filament yarn due to variation draw by out-draw and drawing/false- twist texturing processing, and the multi-filament yarns hexing the sectional shape with the recess and those having the sectional shape without the recess are randomly dispersed in the inner and outer layers. Further, in the structure of the twist yarns to which additional twist is applied, the individual multi-filament yarns have very small shrinkage differences in the longitudinal direction and so provide the puff structure between the single yarns.

They have the similar yarn structure at the points of intersection between the warps and the wefts and when they are immersed in the alkaline weight loss bath, the liquid permeates into the multi-filaments and loss is effected. At this time, the thick portion of the thick-and-thin portions has a greater loss rate than the thin portion, and when single yarn migration is excellent as in the structure described above, the effect of providing the puff property and the drop property is believed great.

Next, the combined and multi-component false twist filament yarn according to the fourth invention of the present invention will be explained.

The fourth invention relates, in short, to the composite yarns to be used for a knitted fabric or a woven fabric, in which the filament yarns false twisted and having a sectional shape with the recess and those having a sectional shape without the recess are randomly dispersed and are mix-woven, and the sectional shape of the filament having the recess has a specific relation with the sectional shape of the filament not having the recess.

The gaps defined by the multi-filaments having the sectional shape with the recess and those having the sectional shape without the recess in the filament arrangement impart an effective water absorption effect to the resulting knitted or woven fabric due to the capillary phenomenon, and because the filament yarns having the sectional shape with the recess are mix-woven, the knitted/woven fabric has an excellent slippery and pliable feeling even under the retaining state of water so absorbed. Further, because the filaments having the sectional shape with the recess and those having the sectional shape without the recess have a specific relation and are mix-textured with one another, they can provide a knitted/woven fabric having an excellent water absorption property even under the additionally twisted state. Because the yarns constituting the knitted/woven fabric are false twisted and crimped, the fabric has high bulkiness, is likely to absorb water, and has excellent water absorption.

The feature of the combined and multi-component false twist filament yarn according to the fourth invention of the present invention resides in the sectional shapes of the multi-filament yarn and its structure of the multi-component state. The void structure defined by the structure of the sectional shapes and the mix-weaving state exhibits the water absorption effect. When the multi-filament yarns are additionally twisted, the change of this void structure is small and the water absorption effect can be maintained. The slippery and pliable feeling can be obtained by additional twist under the conventional hard twist range, and is free from the wet and gooey feeling even under the water retention state due to water absorption.

The combined and multi-component false twist filament yarn of the present invention is the multi-filament yarn formed by compositing filament yarns having mutually different sectional shapes. The kind of the sectional shape is at least two. It is important that at least one kind of the filament yarns has a sectional shape not having the recesses and the rest consist of the filament yarns having the sectional shape having the recesses.

Figure 26:
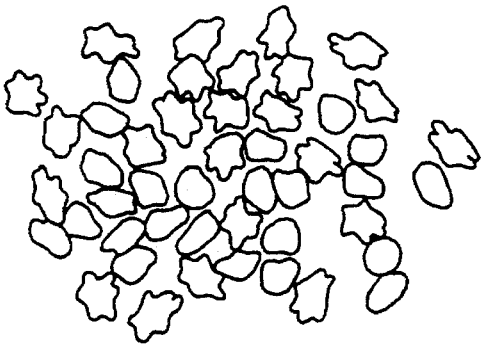
FIG. 26 is a schematic sectional view showing an example of the combined and multi-component false-twist textured filament yarn according to the present invention.
Figure 28:
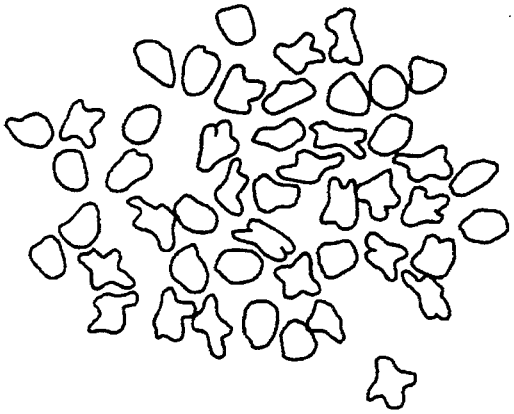
FIG. 28 is a schematic sectional view showing another example of the combined and multi-component false-twist textured filament yarn according to the present invention.
Figure 27:
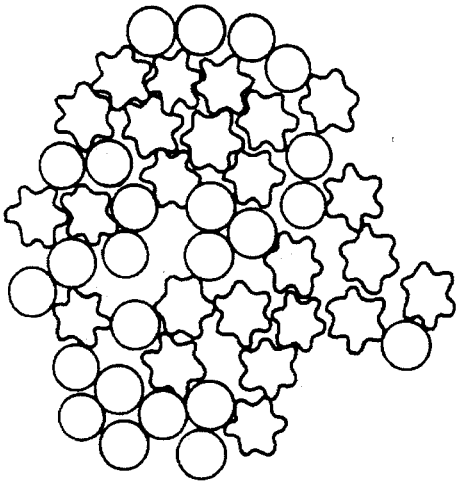
FIG. 27 is a schematic sectional view showing an example of a raw yarn for obtaining the combined and multi-component false-twist textured filament yarn according to the present invention.

FIGS. 26 to 28 are schematic sectional views each shoving an example of the combined and multi-component false twist yarn used for the present invention.

FIG. 26 shows the false twist yarn in which filament yarns having a round section and those having a six-lobed section are randomly dispersed and arranged.

FIG. 27 shows a raw yarn in which the filament yarns having the round section and the filament yarns having the six-lobed section are randomly dispersed and arranged, and when the raw yarns are false twisted, the false twist yarn shown in FIG. 1 can be obtained.

FIG. 28 shows the false twist yarn in which the filament yarns having the round section and the filament yarns having a four-lobed section are randomly dispersed and arranged.

Figure 3:
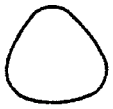
Figure 4:
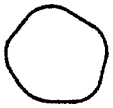
Figure 29:
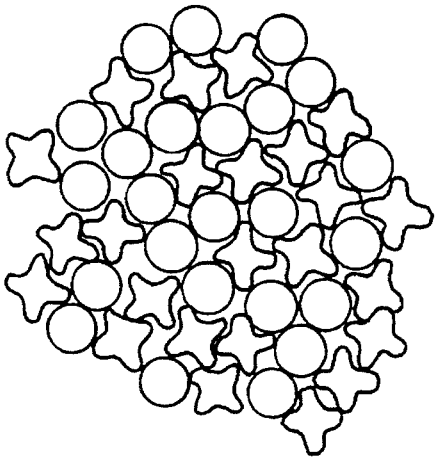
FIG. 29 is a schematic sectional view showing another example of the raw yarn for obtaining the multi-component and composite false-twist textured filament yarn according to the present invention.

FIG. 29 shows the raw yarn in which the filament yarns having the round section and the filament yarns having the four-lobed section are randomly dispersed and arranged, and when the raw yarns are false twisted, the false twist yarn shown in FIG. 3 can be obtained.

As shown in FIGS. 27 and 29, the section having the recesses and the section not having the recesses can be clearly distinguished in the raw yarn, but when the raw yarns are false twisted, the sections undergo deformation as shown in FIGS. 26 and 28. Accordingly, there are the case where the section not having the recesses in the raw yarn come to partially possess the recesses after false-twist texturing and the case where the recessed shape in the raw yarn change and disappear after false-twist teexturing, in the combined and multi-component false twist filament yarn in the present invention.

The sectional shape not having the recess and the sectional shape having the recess in the combined and multi-component false twist filament yarn according to the fourth invention are the same as those described with reference to the first invention, and are explained, for example, with reference to FIGS. 1 to 10.

In the combined and multi-component false twist filament yarn according to the fourth invention of the present invention, gaps are likely to occur between the filaments even under the twisted state because the recesses of the filaments having the sectional shape with the recesses and the filaments having the sectional shape without the recess co-exist. When additional twist is applied to the multi-filament yarns, these gaps are gradually converted to the bundle state and decrease. However, in comparison with the case where the yarns having the sectional shape not having the recesses are individually used or the case where the yarns having the sectional shape having the recesses are individually used, the combined and multi-component false twist filament yarn of the present invention has the effect of reducing the ratio of the decrease of these gaps. In other words, when the yarns having the sectional shape not having the recess are individually used, the gaps cannot be formed, and when the yarns having the sectional shape having the recesses are individually used, the recesses engage with one another and close the gaps, so that the gaps cannot be effectively formed.

In the combined and multi-component false twist filament yarn according to the present invention, the gap structure defined between the recesses of the sectional shape having them and the filament having the sectional shape without the recess exhibit the water absorption effect by the capillary phenomenon under the presence of the moisture content.

Further, since the section having the recesses is suitably arranged at the outer layer portion of the combined and multi-component false twist filament yarn, the protuberances defined between the recesses provide the effect of imparting the dry and slippery and pliable feeling. Moreover, even under the water retention state due to water absorption, the wet and gooey feeling is less than in the structure consisting of the section not having the recesses alone.

Even when twists are imparted by additional twist, the drape property which can be obtained only in the hard twist region in the structure consisting of the section not having the recesses alone can be obtained within a range of a smaller number of twists, and the slippery and pliable feeling can also be obtained. Since the number of twists is smaller, the gaps can be secured more easily, and water absorption is excellent.

In order to obtain the water absorption effect of the gap structure by the capillary phenomenon and the slippery and pliable feeling of the knitted/woven fabric, the number of recesses in the section having the recesses in the present invention is preferably from 2 to 20, particularly preferably, from 2 to 8.

In the combined and multi-component false twist filament yarn according to the present invention, the filament yarn having the sectional shape with the recesses is not limited to only one kind, and filament yarns having mutually different sectional shapes each having a plurality of recesses may be mix-woven and composited.

In the present invention, the ratio of the filament yarns having the sectional shapes each having the recesses is preferably not greater than 80% in order to secure the gap structure by preventing the recesses from engaging with one another and to obtain the water absorption effect by the capillary phenomenon. The drop of the water absorption effect becomes greater with the increase of the number of additional twists, and the feeling changes from the slippery and pliable feeling to the harsh and stiff feeling. On the contrary, the ratio of the filament yarns having the sectional shape without the recesses is preferably at least 20% in order to prevent the drop of the gap structure due to the influences of the section not having the recess and the drop of the water absorption effect, and to prevent the sticky touch to the skin under the water retention state. Further preferably, the ratio of the filament yarns having the sectional shape having the recesses is within the range of 40% to 60%.

In conjunction with the mixing state between the filament yarns having the sectional shape with the recesses and the filament yarns having the sectional shape without the recesses, it is very important that the filament yarns haying the respective sectional shapes be dispersed and mix-woven under the dispersed state. If the filament yarns hexing the sectional shape with the recesses and the filament yarns having the sectional shape without the recesses are mix-textured under the bundled state, respectively, the gap structure does not develop between the recesses and the section not having the recesses, so that the capillary phenomenon does not develop. The mix-texturing state between the filament yarns having the sectional shape with the recesses and the filament yarns having the sectional shape without the recesses may be such that these yarns are dispersed under the random state in their longitudinal directions, respectively, and entanglements due to interlace and loops by taslan processing exist.

When the form of the combined and multi-component false twist filament yarn has the core-sheath two-layered structure, it is only necessary that the random mixing state of the filaments having the sectional shape with the recesses and the filament having the sectional shape without the recesses exists in the group of filaments positioned on the sheath side, and the group of the filaments positioned on the core side need not always assume the mixing state of the different sectional shapes.

It is important that the combined and multi-component false twist filament yarn of the present invention contains those single filaments which have sectional shapes capable of forming the gaps between the sections of the single filaments when at least one kind of the single filament having the sectional shape without the recesses and at least one kind of the single filament having the sectional shape with the recesses come into mutual contact.

For, even when the single filaments of the combined and multi-component false twist yarn are packed most densely, the sufficient gaps can be formed between the filaments and the drape property and the dry feeling can be obtained by additional twisting. Further, the gaps formed in the arrangement of the multi-filaments having the sectional shape without the recesses and the multi-filaments having the sectional shape with the recesses provide the knitted/woven fabric with the effective water absorption property due to the capillary phenomenon. Since the filament yarns having the sectional shape with the recesses are under the mix-woven state, the knitted/woven fabric having excellent slippery and pliable feeling can be obtained even under the water retention state of absorbed moisture content. Because the filaments having the sectional shape with the recesses and those having the sectional shape without the recesses under the specific relation are mixed-woven, the knitted/woven fabric can exhibit the excellent water absorption property even under the additionally twisted state.

Figure 30:
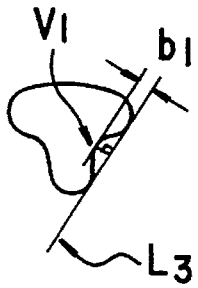
FIG. 30 is an explanatory view useful for explaining the fiber sectional shape having recesses in the present invention.

In the combined and multi-component false twist filament yarn of the present invention, it is preferred that the length of the vertical line, which is drawn to the bottom of a recess defined between the protuberance of the section of the single filament having the sectional shape having the recess and the protuberance adjacent to the former, with respect to a tangent connecting these two protuberances is smaller than the radius of the filament having the sectional shape without the recesses. In the case of FIG. 30, for example, the length $b_1$ of the vertical line drawn from the bottom point $V_1$ of the recess defined between the two protuberances of the single filaments each having the sectional shape with the recesses, with respect to the tangent $L_3$ connecting these two protuberances, is smaller than the radius of the filament having the sectional shape not having the recess.

In this case, since the single filaments not having the recesses are not taken into the single filaments having the recesses, the respective filaments can freely move inside the multi-component yarn when they are twisted. Accordingly, high bulkiness can be secured and the slippery and pliable feeling can be obtained. Further, since the gaps between the fibers are kept as such without being closed, water absorption property can be advantageously maintained.

It is further preferred that the single filament having the sectional shape without the recess has a fiber radius greater than the minimum value of the radius of curvature of the recess defined by the protuberance of the section of the single filament having the sectional shape with the recesses and the protuberance adjacent to the former. For, the filament yarn having the sectional shape without the recess does not engage with the recess of the filament having the sectional shape with the recess in this case, and the drape property and the water absorption property are not impeded.

In the present invention, the sectional shape having the recesses preferably has a value of 5 to 60 in terms of the degree of lobar defined next. More preferably, the sectional shape has the degree of lobar of 10 to 40 and most preferably, from 10 to 30.

Figure 31:
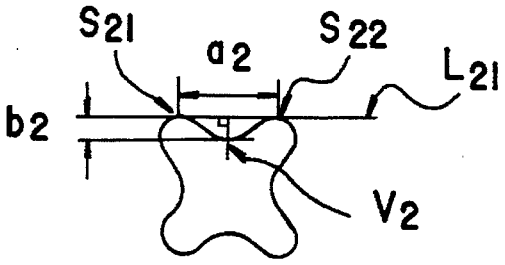
FIGS. 31 and 32 are explanatory views useful for explaining the degree of lobar.
Figure 32:
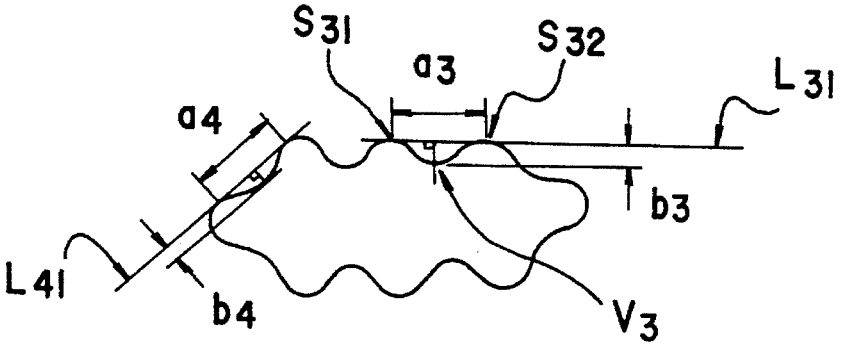

FIGS. 31 and 32 are explanatory views useful for explaining the degree of lobar.

Referring to FIG. 31, the degree of lobar is defined on the section of the raw yarn subjected to the false-twist texturing processing, and represents the percentage (%) of the length $b_2$ of the vertical line drawn from a bottom point $V_2$ of a recess portion defined between one protuberance of the sectional shape of the single filament having the recess and the protuberance adjacent to the former, with respect to the length $a_2$ between two contact points $S_{21}$, $S_{22}$ of the tangent $L_{21}$ connecting these two protuberances. In other words, it is given by degree of lobar$=100\times b_2/a_2$ In FIG. 12, $$\text{degree of lobar} = 100\times b_3/a_3, \text{ or}$$
$$= 100\times b_4/a_4$$

on the other hand, Japanese Patent Laid-Open No. 316624/1992 proposes a specific bulky processed yarn which uses a specific odd-shaped section filament yarn having an odd-shape section coefficient of at least 2.0 and having false twist crimp, as a core yarn, and a false twist crimp yarn thinner than the core yarn as a sheath yarn. The specific odd-shaped section filament yarn used in this prior art reference has the odd-shaped section coefficient of at least 2.0, or in other words, the length of lobes are elongated. Therefore, when twist is applied, the lobes (protuberance portions) are likely to undergo deformation, and because the lobes are likely to engage with one another or the yarns having the round section, which engage with the recesses, are likely to be taken into the lobes, so that the fiber gaps are closed. Accordingly, the water absorption property is low, and the slippery and pliable feeling of the present invention cannot be obtained.

In terms of the odd-shaped section coefficient defined in Japanese Patent Laid-Open No. 316624/1992, the combined and multi-component false twist filament yarn according to the present invention preferably has the coefficient of less than 2.0, more preferably not greater than 1.9 and further preferably not greater than 1.8, provided that the yarn is not the flat odd-shaped section yarn. Incidentally, it is believed that the odd-shaped section coefficient defined by the Patent Laid-Open reference described above cannot be calculated in the base of the flat shape.

A filament yarn consisting of a polyester polymer is used as the filament yarns constituting the combined and multi-component false twist filament yarn of the present invention. A filament yarn consisting of a polyethylene terephthalate polymer or a polyethylene terephthalate copolymer containing at least 85 mol % of ethylene terephthalate units is preferably used. High water absorption can be imparted by using a copolymerized polyethylene terephthalate obtained by copolymerizing polyethylene glycol, 5-sodium sulfoisophthalic acid, etc, as the copolymerization components. The filament yarns having the respective sectional shapes may be constituted by different kinds of polymers. The polyester constituting the filament yarn may contain a matting agent such as titanium oxide, pigments, light-proofing agents, flame-retardants, and so forth.

The relation between the single yarn size D1 of the filament yarn having the sectional shape without the recess and the single yarn size D2 of the filament yarn having the sectional shape with the recesses preferably satisfies the relation $0.5 \leqq D2/D1$ from the aspect of the slimy effect to the feeling brought forth by the filament yarns having the sectional shape without the recess, and preferably $D2/D1 \leqq 2.0$ from the aspect of the effect brought forth by the filament yarns having the sectional shape with the recesses, on the feeling. Preferably both of D1 and D2 are not greater than 10 Deniers.

The filament yarn having the sectional shape without the recess as well as the filament yarn having the sectional shape with the recesses may consist of a single filament yarn having a single size or may consist of a mixture of single yarns having different single yarn sizes.

The boiling water shrinkage ratio of the combined and multi-component false twist filament yarn according to the present invention is preferably from 6 to 15% as the combined and multi-component false twist yarn measured in accordance with JIS L1090A (hank shrinkage ratio). From the aspect of the sectional shape having the recess, the boiling water shrinkage ratio SW1 of the filament yarn having the sectional shape without the recess and the boiling water shrinkage ratio SW2 of the filament yarn having the sectional shape with the recesses preferably satisfy the relation $SW1-SW2 \leqq 8\%$ and more preferably $SW1-SW2 \leqq 5\%$.

Next, an example of the method of producing the combined and multi-component false twist yarn used in the present invention will be explained.

The combined and multi-component false twist filament yarn according to the present invention may be produced by heat-drawing or drawing and false-twist texturing undrawn yarns, semi-drawn yarns (POY), drawn yarns or high speed spun yarns which are spun from spinning holes of a spinneret having a hole shape for discharging the sectional shape not having the recess and a hole shape for discharging the sectional shape having the recesses. Alternatively, it may be a crimp yarn obtained by false twist texturing the heat-drawn yarn by a separate process.

Besides those obtained by the spinneret shape described above, the filaments having the sectional shape with the recesses may be those obtained by combination with a polymer easily soluble in an alkali or those obtained by a split mold by the combination of different kinds of polymers.

Particularly preferably, the combined and multi-component false twist filament yarn of the present invention is obtained by mix-weaving and bundling the filament yarns having the sectional shape with the recesses and the filament yarns having the sectional shape without the recess before they are taken up by the take-up roller of the spinning step and false-twist texturing the polyester undrawn yarns, draw yarns or yarns of high speed spinning in which the filament yarns having different sectional shapes are so mix-textured. Particularly preferred is a method which spins a molten polyester polymer from one spinneret consisting of at least two kinds of spinning holes having mutually different shapes, at least one of which does not have the recess and the other of which have the recesses, from the aspect of the mix-weave state of the constituent filament yarns and from the aspect of productivity. When production is made by using one spinneret having different shapes of spinning holes, the spinning holes for discharging the multi-filament yarns having the sectional shape not having the recess and the sectional shape having the recesses are more preferably arranged at random than in the block shape so as to attain the mix-weaving state of the spun yarns. The form of the composite yarn under the block-like mix-weave state cannot smoothly form the gap structure due to the effective arrangement of the sectional shapes, and does not exhibit sufficient water absorption performance due to the capillary phenomenon. Water absorption tends to drop when the number of additional twists of the combined and multi-component false twist yarn increases.

On the other hand, according to the method which spins a filament yarn having the recess and takes up at one of the ends thereof, separately spins a filament yarn not having the recess and takes up at one of the ends thereof, parallels then these yarns together, mix-weaves them, and draws and false twists the resulting polyester undrawn yarn, semi-drawn yarn, drawn yarn or high speed spun yarn, the mix-weave state is sufficiently dispersed and is difficult to attain a random state.

Next, the drawing and false-twist texturing condition will be explained.

It is important that the draw and false-twist texturing of the polyester undrawn yarn, etc, be carried out at a heater temperature of 110° to 190° C. so that the false twist number $T_2$ (T/m) satisfies the twist coefficient $\alpha$=24,000 to 35,000 with respect to the Denier D after processing.

The heater temperature of less than 110° C. is extremely unstable as the heat set region at the time of the draw and false twist processing, and is not preferred as the region for obtaining the boiling water shrinkage ratio of not higher than 15% because production control is difficult. When the heater temperature exceeds 190° C., a boiling water shrinkage ratio of at least 6%, which contributes to the puff property, cannot be obtained.

If the twist coefficient $\alpha$ at the time of false twist processing is less than 24,000, the shape of the multi-filament yarn approaches the shape of the raw yarn particularly in the region having a low false twist temperature, and the puff feeling is inferior to that of the conventional false twist two-layered structure yarn. When the twist coefficient $\alpha$ exceeds 35,000, crimps become greater in the region of a high false twist temperature in the same way as in the conventional false twist yarns, and the hard and sandy feeling is applied to the feeling of the woven fabric due to the influences of crimp characteristics.

The properties of the multi-filament yarn obtained by the draw and false twist processing are such that the boiling water shrinkage ratio Sw (%) is 6 to 15%, the crimp rigidity CR (%) is not greater than 35% among the crimp characteristics, and the crimp appearance stretch ratio TR (%) in the heat-treatment under load is not greater than 5%. These properties are preferred because the slippery and pliable feeling and the drape property can be effectively imparted to the woven fabric which is obtained by additionally twisting this combined and multi-component false twist yarn and dyeing it.

The boiling water shrinkage ratio SW (%), the crimp rigidity CR (%) and the crimp appearance stretch ratio TR (%) in the heat-treatment under load are all measured by the methods described already.

On the other hand, when out-draw and draw and false twist processings are carried out as in the production method of the second invention of the present invention, thick-and-thin variation can be imparted to the combined and multi-component false twist yarn in the longitudinal direction of the fiber. (This corresponds to a combined and multi-component false twist yarn according to the fifth invention of the present invention). In this case, it is important that the thick-and-thin variation is at least 0.8% in terms of uster evenness.

Figure 33:
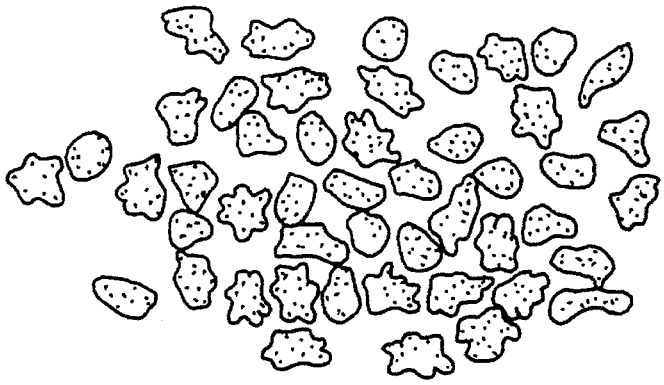
FIG. 33 is a sectional view (dense dyed portion) showing an example of the combined and multi-component false-twist textured filament yarn according to the present invention.

FIG. 33 is a sectional view showing an example of the combined and multi-component false twist yarn according to the present invention (dense dyed portion).

Figure 34:
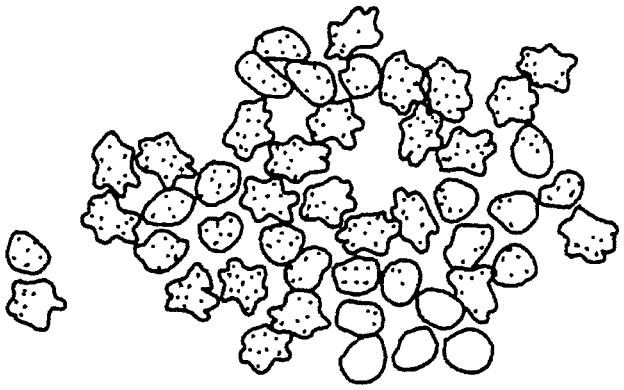
FIG. 34 is a sectional view (light dyed portion) showing an example of the combined and multi-component false-twist textured filament yarn according to the present invention.

FIG. 34 is a sectional view showing an example of the combined and multi-component false twist yarn according to the present invention (light dyed portion).

FIGS. 33 and 34 show the thick yarn portion (dense dyed portion) and the thin yarn portion (light dyed portion) of the combined and multi-component false twist yarn obtained by out-drawing and false-twist texturing the raw yarns consisting of the filament yarns having a round (circular) section and the filament yarns having a six-lobed section. Incidentally dots in the fiber section represent the existence of titanium oxide.

Unique effects such as the puff property, the drape property, the slippery and pliable feeling, etc, can be imparted to the woven fabric by imparting the thick-and-thin portions to the multi-filament yarns by out-drawing and false twist processing of the undrawn or semi-drawn yarns.

In other words, the difference of the shrinkage ratios occurs due to the difference of birefringence between the multi-filaments generated by simultaneous spinning of the multi-filaments having the sectional shape with the recess and the multi-filaments having the sectional shape without the recess, and further due to the difference of birefringence between the thick and thin portions of the thick-and-thin portions of each multi-filament yarn generated by out-draw.

This difference of the shrinkage ratios is dispersed at random by single yarn migration at the time of drawing and false-twist texturing, and mix-weaving by interlace processing, and appears as the difference of shrinkage inside and between the multi-filaments in the dyeing process of the woven fabric after additional twist and weaving of the combined and composite yarn. Accordingly, the difference of the shrinkage ratios so operate as to reduce the contact areas of the multi-filaments, and greatly contributes to the puff property, the drape property and the smooth touch of the woven fabric.

This thick-and-thin characteristic is measured by the uster evenness U %, and it is important that the U % value be at least 0.8%. If it is less than 0.8%, the difference of the shrinkage ratios is small between and inside the single yarns and contribution to the puff property, in particular, becomes small, though it is associated with the boiling water shrinkage ratio. Particularly preferred range of the uster evenness U % is from 1.0 to 3.0%.

The thick portion of the composite mix-woven yarn has relatively low birefrigence and relatively great amorphous portions. Therefore, it has relatively high dyeability and forms the dense dyed portion. On the other hand, the thin portion has relatively high birefringence and relatively small amorphous portions. Therefore, it has relatively low dyeability and forms the light dyed portion.

It is further effective in the production process of the combined and multi-component false twist filament yarn of the present invention to impart entanglement between the single yarns by the interlace nozzle after the drawing and false-twist texturing step but before the take-up step. The application of entanglement between the single yarns improves the mix-weaving effect between the multi-filament yarns having the sectional shape with the recesses and those having the sectional shape without the recess, causes their migration and improves the effect of the present invention. It also provides the effect of improving the pass property at the post-step of the combined and multi-component false twist yarn. The degree of entanglement is preferably at least 10 pcs/m.

Next, the knitted/woven fabric according to the sixth and seventh inventions of the present invention will be described.

When the combined and multi-component false twist filament yarn according to the fourth invention or the combined and multi-component false twist filament yarn (U %≧0.8) according to the fifth invention is used as the warps and/or the wefts, the resulting woven fabric has excellent water absorption in both directions of the warps and the wefts due to the capillary phenomenon, and when they are used for only the warps or the wefts, the excellent water absorption effect can be used in the direction in which the combined and composite false twist yarn is used.

When the combined and multi-component false twist yarn described above is used for the knitted/woven fabric, the range of the number of twists which provides the excellent effect by additional twist in the twisting step is as follows in connection with the Denier used:

$T=\alpha\cdot D^{-1/2}$

T: the number of additional twists [T/M]

α: twist coefficient

D: Denier of yarn

In the equation given above, the twist coefficient is within the range of 2,400≦14,500.

When a yarn different from the combined and multi-component false twist yarn is used for the warps or the wefts, the kind of such a yarn may be a synthetic fiber multi-filament yarn, a natural fiber spun yarn, a synthetic fiber spun yarn, a blended yarn of the natural fiber yarn and the synthetic fiber yarn or a multi-component yarn of the natural fiber (short fiber) yarn and the synthetic fiber multi-filament yarn.

The texture and the structure of the woven fabric may be the three foundation weave, its variation weave and a double weave having different kinds of yarns on both surfaces.

In the case of the knitted fabric, the effect of the combined and multi-component false twist yarn can be exhibited in both circular knitting and warp knitting. In circular knitting, the knit structure may be sheeting or interlocking when the combined and multi-component false twist yarn is used, and when a union knit for alternately forming loops, rib portions and plane portions are constituted, union knit with the combined and multi-component false twist yarn and other raw yarns may be used.

In the case of warp knitting, a warp base may be arranged at any positions of front, middle and back, and the warp fabric may be used for weft insertion.

As described above, when the combined and multi-component false twist yarn described above is used, the water absorption effect due to the excellent capillary phenomenon and the smooth and dry feeling can be obtained, but this effect can be further improved by the treatment with a finishing agent containing a hydrophilic resin in the dyeing process. This resin finish imparts the moisture diffusion effect to the woven fabric and can impart desirably fast dry property.

The combined and multi-component false twist yarn has excellent liquid permeability as represented by the water absorption effect due to the excellent capillary phenomenon. Accordingly, chemical functional processings of fabrics using a chemical processing method by a solution, such as contamination-proofing processing and flame-retardancy processing, can be carried out within a shorter time than the prior art methods, and equivalent or higher contamination-proofness, flame-retardance and other functions can be imparted.

Water absorption can be evaluated by the following method by using a Bireck method in JIS L1096 "Ordinary Woven Fabric Testing Method".

Figure 35:
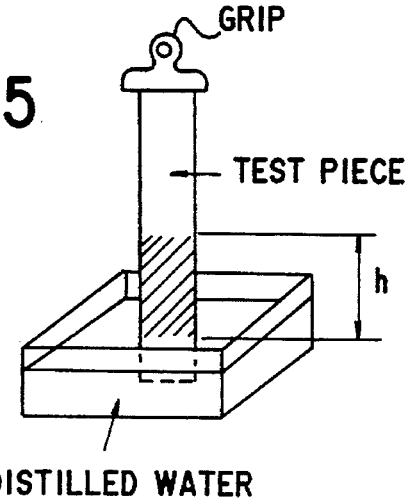
FIG. 35 is an explanatory view useful for explaining a measurement method of water absorption by a Bireck method.

First, five testpieces each having a size of 1 cm by about 20 cm are collected in both longitudinal and transverse directions. Next, one of the ends of each testpiece is gripped and fixed, and the other end in a length of about 2 cm is immersed in distilled water at 20° C.±2° C. as shown in FIG. 35. About ten minutes later, the rising distance of water due to capillary (mm, h in FIG. 35) is measured (which is read accurate to ½ mm), and the evaluation value is expressed by a mean value of measurement carried out five times in both longitudinal and transverse directions (decimals omitted).

When the rise of water cannot be read easily, ink or a water-soluble dye (Eosin) is charged into distilled water, or the water-soluble dye (Eosin, etc) is allowed to adhere in advance to each testpiece by using a brush.

The water absorption property of the knitted/woven fabric having water absorption according to the present invention depends on the number of additional twists of the combined and multi-component false twist yarn used, the weave structure of the testpiece, its knit structure, its weave density, its knit density, etc, but in the case of plain weave having the number of additional twists of 300 T/M, for example, the distance of ascension (after 10 minutes) by the Bireck method is preferably at least 100 mm. By the way, the greater the number of additional twists, the smaller becomes the distance of ascension.

Embodiment

Hereinafter, the present invention will be explained more definitely with Examples thereof.

The characteristic values in the following Examples are determined by the following methods.

The boiling water shrinkage ratio SW (%) and the crimp rigidity CR (%) are determined in accordance with JIS L1090 (Testing Method of Synthetic Fiber Multi-filament Bulky Finished Yarn). Incidentally, SW (%) is determined by the boiling water shrinkage ratio A method (hank shrinkage ratio).

The crimp appearance shrinkage ratio TR (%) under load by heat-treatment is determined by the following method.

A hank is formed by winding five times a multi-component yarn, and an initial load having an apparent size of 0.02×D (g) (where D is a Denier of the composite yarn). Dry heat-treatment is then carried out at 150°±2° C. for 5 minutes, and a constant load of 0.1×D (g) of the apparent size is applied so as to obtain a length ratio.

$$TR\ (\%)=100\times(l_1-l_2)/l_2$$

where $l_1$: hank length when constant load is applied, $l_2$: hank length when initial load is applied and dry heat-treatment is made.

Water absorption is evaluated by using the Bireck method in JIS L1096 "Ordinary Woven Fabric Testing Method".

The degree of entanglement by the interlace processing is determined by the following method.

Measurement is made under the measuring condition by using an entanglement tester Model R-2040, a product of Rothschild Co., and an electronic tensiometer Model R-1192:

trip tension Tr=(2×D/F)+(D/10)

pre-tension Tp=D/10

In the equations given above, D is the size (Denier) of the yarn to be measured and F is the number of filaments constituting the yarn. The yarn velocity at the time of measurement is 1.0 cm/min. Measurement is made 50 times per sample, and the value obtained by cumulatating the values from the measuring instrument is expressed by $E_{50}$. Then, the degree of entanglement is determined by the following equation:

$$\text{degree of interlace entanglement (pcs/m)}= 50{,}000/E_{50}$$

Example 1 & Comparative Examples 1, 2

Polyethylene terephthalate having an intrinsic viscosity of [η]=0.64 was spun at a rate of 3,000 m/min by the process shown in FIG. 17 using a spinneret having 24 round holes and 24 six-lobed (hexalobar) holes shown in 20, and a semi-drawn yarn having a Denier of 261 and 48 filaments was obtained.

When this semi-drawn yarn was drawn and false twisted by a friction system draw/false twister Model DF-7, improved model, a product of Toray Engineering Co., a heat pin temperature between rollers was set to 74° C. and out-draw was effected at a raw ratio of 1.38. Subsequently, drawing and false-twist texturing processing was carried out at a heater temperature of 130° C., the number of false twists of 2,400 T/M (α= 31,000 with respect to the resulting finished yarn Denier of 167 D), a draw ratio of 1.15, a processing rate of 351 m/min and a degree of interlace entanglement of 253. A twisting tension in the false-twist texturing process was 30.4 g/pcs, an untwisting tension was 19.4 g/pcs, the number of fluffs occurred was 0 pc/2000 m, and quality as well as processability were excellent.

As a result of the false-twist texturing processing described above, there could be obtained a false twist crimp yarn (combined and multi-component yarn) having a size of 167 Deniers, a strength of 3.4 g/d, an elongation of 33%, a boiling water shrinkage ratio of 7.8%, a uster evenness U % of 1.96%, a crimp rigidity CR of 24.7% and a crimp appearance stretch ratio TR of 3.7% by heat-treatment under load.

When the section of the resulting combined and multi-component yarn was observed through an optical microscope by an embedding method, the yarn was found to have the structure wherein filament yarns having the sectional shape which was a deformed round shape from the round section and did not have the recess and filament yarns having the sectional shape in which the six-lobe section was deformed due to the drawing and false-twist texturing processing and which had the recesses had partially different thickness portions due to the thick-and-thin effect brought forth by out-draw as shown in FIG. 11 or 12, and were randomly distributed in the inner and outer layers without having the two-layered structure, respectively.

The knitted fabric obtained by knitting this false twist yarn by an ordinary circular knitting machine had a peculiar slippery and pliable feeling and an excellent drape property in comparison with the false twist crimp yarn having the round section 100% (Comparative Example 1) obtained under the same spinning and drawing and false-twist texturing condition as described above or with the false twist crimp yarn having the six-lobed section 100% (Comparative Example 2).

Example 2 & Comparative Example 3

Additional twist of 1,000 T/M was applied to the combined and multi-component yarn (167 Deniers, 48 filaments) consisting of 24 filament yarns having the sectional shape without the recess and 24 filament yarns having the sectional shape having about 6 recesses, each being obtained after drawing and false-twist texturing process in Example 1, using a double twister Model 308 of Murata Kikai K.K. After twist set was made at 70° C. for 40 minutes by vacuum steam, the additional twist yarn was warped into warps and was applied to a water jet loom without a paste. A 2/2 twill was woven at 450 rpm to a density of 150 warps/2.54 cm and 70 wefts/2.54 cm by using the same false twist crimp yarn as the warps, as the wefts.

In ordinary dyeing process, the resulting grey goods was subjected to liquid stream relax processing at 100° C., intermediate set at 190° C., alkali weight loss processing (loss ratio 23%) at 130° C., liquid stream dyeing processing at 130° C. and finish set by dry heating at 160° C.

For comparison, the yarn was obtained by the same spinning, out-draw and drawing and false-twist texturing steps as those of Example 1 except that a spinneret having only the round sectional holes was used. The resulting yarn was woven by the same method as described above and was dyed by the same batch (Comparative Example 3).

In comparison with the product consisting solely of the yarns having the round sectional shape, the dyed and finished fabric consisting of the combined and multi-component yarn having different sectional shapes had less slimy feeling and peculiar slippery and pliable feeling and was excellent in bulkiness and particularly, in the drape property. Therefore, the product had high commercial value.

Example 3

Polyethylene terephthalate having an intrinsic viscosity [η]=0.64 was spun by using a spinneret having 12 round holes and 12 six-lobed (hexalobar) holes as shown in FIG. 12, and a semi-drawn yarn having 134 Deniers and 24 filaments was obtained by the same spinning process as that of Example 1.

Next, the drawing and false-twist texturing processing was applied to the resulting semi-drawn yarn by using the same drawing and false twister as the one used in Example 1 at a heat pin temperature of 77° C. and a draw ratio of 1.42 as the out-draw condition, and at a heater temperature of 130° C., the number of false twists of 3,320 T/M ($\alpha$=29,095 with respect to the Denier 76.8 D of the resulting finished yarn), a draw ratio of 1.26 and a processing rate of 421 m/min as a subsequent false twist condition, and 0.8 mmϕ×2 holes nozzle and air pressure of 2.4 kg/cm$^2$ as a drawing and false twist condition. Processability was excellent in the same way as in Example 1.

As a result of the false-twist texturing processing described above, there could be obtained a thick-and-thin combined and multi-component yarn having a size of 77 Deniers, a strength of 4.1 g/d, elongation of 24.5%, a boiling water shrinkage ratio of 10.1%, a uster evenness U % of 0.93, a crimp restoration ratio CR of 29.6%, a crimp appearance stretch ratio TR of 5.0% by heat-treatment under load, a torque twist number of 41 T/50 cm, a dry heat shrinkage stress maximum value of 14.0 g/122° C., a degree of interlace entanglement of 202, a methanol extraction oil content of 1.4% and the number of fluffs of 0 pc/2,000 m.

A 5 kg bobbin cheese was divided into 1.2 kg bobbins using the resulting combined and multi-component yarn by a pirn winder (a product of Murata Kikai K.K.) at 300 m/min. Additional twist of 1,000 T/M was applied to the pirn by a double twister (Model 308, a product of Murata Kikai K.K.). The number of revolution of a spindle was 12,000 rpm.

The resulting additional twist yarn was subjected to twist set by a vacuum steam processing machine at 70° C. for 40 minutes. Thereafter, ordinary processings such as beam-warping and beaming were carried out, and the yarn was woven into a plain weave by a water jet loom (Model 302, a product of Tusdakoma K.K.). The density of the grey goods was 127 yarns/2.54 cm×80 yarns/2.54 cm.

Next, relax and untwisting were sufficiently carried out by a liquid stream relax processing at 110° C. for the resulting grey goods in the ordinary dyeing processing, and the width was fixed by intermediate set at 190° C. by dry heating. Alkali weight loss processing (loss ratio 25%) at 130° C., liquid stream dyeing processing at 130° C. and finish set at 160° C. by dry heating were sequentially carried out.

The density of the resulting dyed fabric was 166 pcs/2.54 cm×100 pcs/2.54 cm. The fabric had a dry touch with slippery and pliable feeling, a soft puff property and drape property having excellent repulsion characteristics.

Example 4

Polyethylene terephthalate having an intrinsic viscosity [η]=0.64 was spun at a rate of 3,000 m/min by using a spinneret having 24 round holes and 24 six-lobed (hexalobar) holes, and there could be obtained a semi-drawn yarn having 261 Denier and 48 filaments (containing 0.45 wt % titanium oxide).

Next, the resulting semi-drawn yarn was drawn and false twisted by an ordinary circumscription friction type draw/twister, and a false twist yarn could be obtained.

The resulting false twist yarn had a size of 150 Deniers, a strength of 3.9 g/d, elongation of 28%, a boiling water shrinkage ratio of 7.8%, a crimp rigidity CR of 26%, a crimp appearance stretch ratio TR of 3.5% by heat-treatment under load, and a degree of interlace entanglement of 215.

When the section of the resulting combined and multi-component false twist yarn was observed through an optical microscope by a embedding method, the yarn was found to be a multi-filament yarn having the structure wherein a filament yarn having the sectional shape whose round section changed to a deformed circular shape due to the drawing and false twist process, and which did not have the recess, and a filament yarn having the sectional shape whose six-lobed shape was deformed due to the drawing and false-twist texturing processing, and which had the recesses, were randomly dispersed.

The maximum value of the lengths of the vertical lines drawn to the bottom of the recess defined between a protuberance of the section of the mono-filament having the six-lobed sectional shape and another adjacent to the former, with respect to the tangent connecting these two protuberances, was 2.5 μm, whereas the yarn diameter of filament yarn not having the recess was 7.4 μm.

To weave the resulting combined and multi-component false twist yarn, additional twist of 750 T/M was applied in the S direction as the wefts, and the yarn was applied to the water jet loom. A plain weave was obtained by applying hard twist of 3,000 T/M in the S and Z directions to ordinary round section polyester multi-filament yarn having a size of 75 Deniers and 72 filaments (containing 0.45 wt % of titanium oxide).

This grey goods was subjected to ordinary dyeing processing, relax untwisting at 120° C., dry heat pre-set at 190° C., alkali loss (25%) and finish set, and was finished to a print foundation. The resulting woven fabric had a warp/weft density of the grey goods(number of yarns per 2.4 cm) of 86×76, and 105×94 after finish processing.

The water absorption property and the feeling were functionally evaluated as the characteristics of the woven fabric. When water absorption was measured by the method already described, the water absorption height in the longitudinal direction was 38 mm after one minute and 100 mm after 10 minutes, and the water absorption height in the transverse direction was 23 mm after one minute and 81 mm after 10 minutes.

The samples of the same woven fabric were washed five times by an ordinary washing machine and the water absorption height was measured by the same method as described above. As a result, the height in the longitudinal direction was 16 mm after one minute and 72 mm after 10 minutes, while it was 8 mm after one minute and 40 mm after 10 minutes.

The feeling of this woven fabric was a smooth and peculiar feeling different from the dry feeling of the woven fabric according to the prior art obtained by spinning the polyester multi-filament yarn having a round section, hard twisting it and using it for both warps and wefts.

Example 5

24 filaments having a size of 130 Deniers were spun by two-filament spinning using the same spinneret as that of Example 4, and a semi-drawn yarn (containing 0.45 wt % of titanium oxide) was obtained. Drawing and false twist processing was carried out at a hot plate temperature of 130° C. for the resulting semi-drawn yarn by the friction system draw/false twister. There could be obtained a finished yarn having a size of 74.6 Deniers, a strength of 4.1 g/d, elongation of 20.4%, a boiling water shrinkage ratio of 10.2%, a crimp rigidity CR of 32.1, a crimp appearance stretch ratio TR of 4.3 by heat-treatment under load, and a degree of interlace entanglement of 212.

The resulting combined and multi-component false twist yarn had the same sectional shape as that of Example 4.

Additional twist was made for this yarn as the warps at 1,300 T/M in the S direction. Hard twist was applied to ordinary round section multi-filament yarn having a size of 75 Deniers and 36 filaments (not containing titanium oxide) as the wefts at 3,000 T/M in both S and Z directions, and a fancy plain woven fabric (mat) was woven. This woven fabric was sequentially subjected to ordinary dyeing process, untwisting relax at 120° C., dry heat pre-set at 190° C., 28% alkali weight loss and 160° C. dry heat set, and was finished to a texture for a print foundation. The woven fabric had a grey goods density of 133 pcs/2.54 cm by 74 pcs/2.54 cm and a finish density of 167 pcs/2.54 cm by 90 pcs/2.54 cm.

The water absorption property of the resulting woven fabric was evaluated by the method described above. The water absorption height was 51 mm after one minute and 129 mm after 10 minutes in the longitudinal direction and was 35 mm after one minute and 65 mm after 10 minutes in the transverse direction.

The feeling of this woven fabric had superior water absorption to the woven fabric of the following Comparative Example, and had smooth and extremely mild feeling different from the dry feeling of the conventional hard twist woven fabrics.

Comparative Example 4

Hard twist was applied at 2,500 T/M in both S and Z directions to a polyester multi-filament yarn obtained by ordinary spinning and drawing processing, having a size of 75 Deniers and 36 filaments (containing 2.3 wt % of titanium oxide) and having a round section. Two S twist yarns and two Z twist yarns were alternately arranged as the wefts, while one S twist yarn and one Z twist yarn were alternately arranged as the warps. In this way, a fancy mat woven fabric was woven.

As ordinary dyeing processing, this woven fabric was sequentially subjected to 120° C. untwisting relax, 190° C. dry heat pre-set, 25% alkali weight loss and 160° C. finish set, and a print foundation was obtained. The resulting woven fabric had a grey goods density of 82 pcs/2.54 cm by 80 pcs/2.54 cm, and a finish density of 102 pcs/2.54 cm by 96 pcs/2.54 cm.

The water absorption property of the resulting woven fabric was evaluated by the method described above. The absorption height was 28 mm after one minute and 63 mm after 10 minutes in the longitudinal direction, and was 26 mm after one minute and 53 mm after 10 minutes in the transverse direction.

The feeling of this woven fabric was the dry feeling due only to the twisting effect of the hard twist woven fabric by full-dull raw yarn known generally in the past.

Examples 6 to 11 & Comparative Examples 5 and 6

Polyethylene terephthalate having an intrinsic viscosity $[\eta]=0.64$ was spun and paralleled by an ordinary melt-spinning method at a rate of 3,000 m/min by the process shown in FIG. 19 by using each of spinnerets having 24 round holes and three-lobed holes (Y holes), four-lobed holes, five-lobed holes, six-lobed holes and eight-lobed holes, as the sectional shapes having the recesses, and a semi-drawn yarn having a size of 270 Deniers and 48 filaments was obtained. Among them, the degrees of lobar of the semi-drawn yarns having the sectional shapes having the recesses were 10.1 for three-lobed type (Example 6), 24.3 for the four-lobed type (Example 7), 28.3 for the five-lobed type (Example 8), 21.8 for the six-lobed type (Example 9) and 12.6 for the eight-lobed type (Example 10).

The same polyethylene terephthalate as described above was spun by the ordinary melt-spinning method at a rate of 3,000 m/min by the process shown in FIG. 18 by using a spinneret having 24 round holes and 24 six-lobed holes as the sectional shape having the recesses, and a semi-drawn yarn having a size of 270 Deniers, 48 filaments and the degree of lobar of the six-lobed shape of 22.4 (Example 11).

As Comparative Example, on the other hand, the same polymer was spun and paralleled at a rate of 3,000 m/min by the process shown in FIG. 19 by using a spinneret having 24 round holes alone, and a semi-drawn yarn having a size of 270 Deniers and 48 filaments was obtained (Comparative Example 5). Similarly, the polymer was spun and paralleled by the ordinary melt-spinning method at a rate of 3,000 m/min by the process shown in FIG. 19 by using a spinneret having 24 round holes and 24 triangular holes not having the recesses, and a semi-drawn yarn having a size of 270 Deniers and 48 filaments was obtained (Comparative Example 6).

The respective semi-drawn yarns were drawn and false twisted by the ordinary circumscription friction type draw/false twister at a false twist rate of 450 m/min, a heat plate surface temperature of 130° C. and a processing ratio of 1.74 times. There was thus obtained a false-twist textured finished yarn.

The properties of the resulting false-twist textured finished yarn are illustrated in Table 1.

Additional twist of 300 T/M in the S direction (twist coefficient $\alpha=3,674$) and 1,500 T/M (twist coefficient $\alpha=18,371$) to each of the eight kinds of false-twist textured finished yarns (Examples 6 to 11 and Comparative Examples 5 and 6). Each of the yarns was put to the water jet loom as the warps, and ordinary round section polyester multi-filament yarn having a size of 75 Deniers and 72 filaments, to which hard twist of 3,000 T/M was applied in both S and Z directions, was used as the wefts. There was thus obtained a plain woven fabric.

In the ordinary dyeing processing, the resulting grey goods was subjected sequentially to 120° C. relax untwisting, 190° C. dry heat pre-set, alkali weight loss (loss ratio of 25%), 130° C. dyeing and finish set, and there was obtained a print foundation. The resulting woven fabric had a grey goods warp/weft density (per 24 cm) of 86 by 76, and 105 by 94 after finish processing.

The functional comparative test of the feeling, the drape property and luster, and comparative test of the water absorption property were carried out for these woven fabric rolls. The results are also tabulated in Table 1. Incidentally, four-stage evaluation was made by the functional test for the slippery and pliable feeling, the drape property and luster in Table (double circle represents especially excellent, circule does excellent, triangle does somewhat inferior, and X does inferior).

The woven fabrics obtained from the combined and multi-component false twist filament yarn of the present invention (Examples 6 to 11) had the smooth touch feeling different from the feeling obtained by hard twist, excellent drape property, mild luster and excellent water absorption in comparison with the hard twist woven fabrics using the conventional polyester multi-filament yarns having the round section alone for the warps and wefts for this kind of woven fabrics.

In contrast, the comparative products (Comparative Examples 5 and 6) had inferior feeling, and at the number of twists of 1,500 T/M, the products had inferior drape property and low water absorption.

Example 12

Figure 20:
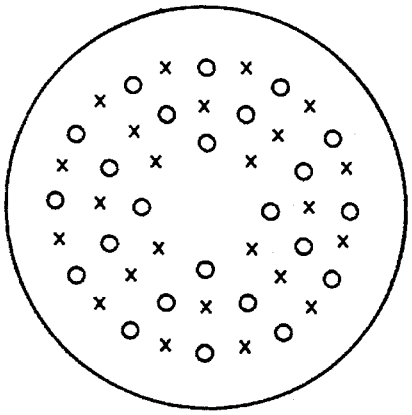
FIGS. 20 to 24 are schematic plan views showing an example of a spinneret used for the present invention.
Figure 23:
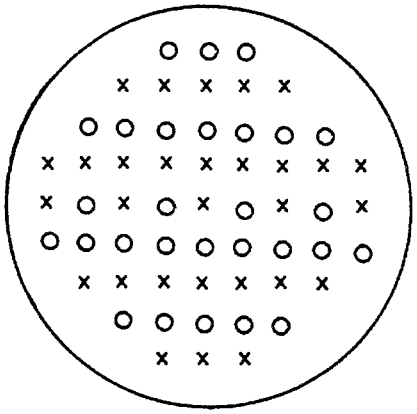
Figure 21:
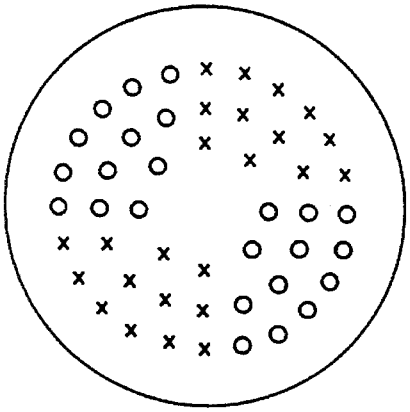
Figure 24:
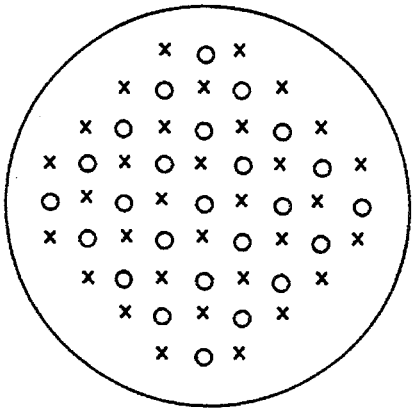
Figure 22:
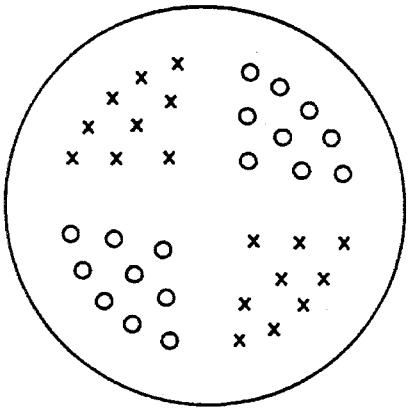

Polyethylene terephthalate having an intrinsic viscosity [η]=0.64 was spun at a rate of 3,000 m/min by the process shown in FIG. 18 by using a spinneret having 24 round holes and 24 six-lobed (hexalobar) holes shown in FIG. 20, and a semi-drawn yarn (containing 0.45 wt % of titanium oxide) having a size of 134 Deniers and 24 filaments were taken up by double-yarn winding.

Next, this semi-drawn yarn was out-drawn at a draw ratio of 1.42 by setting a hot pin temperature to 77° C. by a circumscription friction type draw/false twister equipped with an out-draw apparatus, and subsequently, the draw and false-twist texturing process was executed at a heater temperature of 130° C., the number of false twists of 3,320 T/M, a draw ratio of 1.26, a processing rate of 421 m/min, and 0.8 mmϕ×2 hole nozzle air pressure of 2.4 kg/cm$^2$ as the interlace processing.

As a result of false-twist texturing processing described above, a thick-and-thin combined and multi-component false twist yarn having a size of 77 Deniers, a strength of 4.1 g/d, elongation of 24.5%, a boiling water shrinkage ratio of 10.1%, a uster evenness U % of 0.93, a crimp rigidity CR of 29.6%, a crimp appearance stretch ratio TR of 5.0% by heat-treatment under load and a degree of interlace entanglement of 202 could be obtained.

Additional twist of 1,300 T/M in the S direction was applied to the resulting composite filament yarn, and then the yarn was subjected to vacuum steam heat-treatment at 70° C. for 40 minutes, and then to ordinary steps such as beam warping and beaming, and the water jet loom.

The same yarn as the warps was used as the wefts, and a plain woven fabric having a grey goods density of 98 pcs/2.54 cm by 78 pcs/2.54 cm was woven. In the ordinary dyeing process, this grey goods was subjected sequentially to relax 110° C. liquid stream relax, 190° C. dry heat pre-set, 130° C. continuous alkali weight loss (25%) and 130° C. liquid stream dyeing by using the liquid stream dyeing machine. Finish set was made by 160° C. dry heating. The density of the dyed fabric was 117 pcs/2.54 cm by 93 pcs/2.54 cm.

When this dyed fabric was measured by the water absorption measurement method described above, it had the water absorption height of 42 mm after one minute and 102 mm after 10 minutes in the longitudinal direction and 38 mm after one minutes and 98 mm after 10 minutes in the transverse direction, and the fabric had excellent water absorption effect.

This woven fabric had a peculiar feeling different from the feeling of the conventional hard twist woven fabric using the yarns having the round section, and was free from the wet and gooey feeling even under the water absorption state.

Comparative Example 7

Hard twist was applied at 2,500 T/M in both S and Z directions to polyester multi-filament yarn obtained by spinning and drawing by the ordinary method and having a round section, a size of 75 Deniers and 36 filament (containing 2.3 wt % of titanium oxide). Two S twist yarns and two Z twist yarns were alternately arranged as the warp and one S twist yarn and one Z twist yarn were alternately arranged as the weft, and a fancy mat woven fabric was woven.

In the ordinary dyeing process, this woven fabric was subjected sequentially to 120° C. untwisting relax, 190° C. dry heat pre-set, 25% alkali weight loss and 160° C. finish set, and a print foundation was obtained. The resulting woven fabric had a grey goods density of 82 pcs/2.54 cm by 80 pcs/2.54 cm, and a finish density of 102 pcs/2.54 cm by 96 pcs/2.54 cm.

The water absorption property of the resulting fabric was evaluated by the method described above. The water absorption height was 28 mm after one minute and 63 mm after 10 minutes in the longitudinal direction, and 26 mm after one minute and 53 mm after 10 minutes in the transverse direction.

The feeling of this woven fabric was the same as the dry feeling by only the twist effect of the conventional hard twist woven fabric using the full dull raw yarns.

Examples 13 to 16 & Comparative Example 7

Polyethylene terephthalate having an intrinsic viscosity of [η]=0.64 was spun and paralleled at a rate of 3,000 m/min by the ordinary melt-spinning method by the process shown in FIG. 18 by using spinnerets having 24 round holes and 24 four-lobed, six-lobed and eight-lobed holes as the sectional shapes having the recesses, respectively, and a semi-drawn yarn having a size of 270 Deniers and 48 filaments was obtained. Among them, the degrees of lobar of the semi-drawn yarns having the sectional shape with the recesses were 24.2 for the four-lobed type (Example 13), 21.9 for the six-lobed type (Example 14) and 12.7 for the eight-lobed type (Example 15), respectively.

The same polyethylene terephthalate as used above was similarly spun by the ordinary melt-spinning method at a rate of 3,000 m/min by the process shown in FIG. 17 by using a spinneret having 24 round holes and 24 six-lobed holes as the sectional shape having the recesses shown in FIG. 20, and a semi-drawn yarn having a size of 270 Deniers and 48 filaments, and a six-lobed section (degree of lobar of 22.3) (Example 16).

For comparison, the same polyethylene terephthalate as described above was spun and paralleled by the ordinary melt-spinning method at a rate of 3,000 m/min by the process shown in FIG. 18 by using a spinneret having only 24 round holes, and a semi-drawn yarn having a size of 270 Deniers and 48 filaments was obtained (Comparative Example 7).

Each of the semi-drawn yarns obtained by the method described above was out-drawn at a temperature of 74° C. for the heat pin 8, and a draw ratio of 1.38 between the rollers 7 and 9 by the steps shown in FIG. 25, and was subsequently drawn and false twisted at a surface temperature of 130° C. for the hot plate 10, the number of false twists of 2,400 T/M, a draw ratio of 1.18 times between the rollers 9 and 13, and a processing rate of 360 m/min. Thereafter, the twist yarn was subjected to the interlace treatment at a 0.8 mmϕ×2 hole nozzle air pressure of 1.6 kg/cm$^2$ and was taken up to the cheese 18.

The properties of the resulting thick-and-thin false-twist textured finished yarns were tabulated in Table 2.

Additional twist of 300 T/M (twist coefficient α =3,674) and 1,500 T/M (twist coefficient α=18,371) in the S direction was applied to the five kinds of resulting thick-and-thin false-twist textured finished yarns (Examples 13 to 16, Comparative Example 7). After being passed through vacuum steam heat-treatment at 70° C. for 40 minutes, beam warping, beaming, etc, they were applied as the warps to the jet water loom. On the other hand, the same yarn as the warp was used as the weft, and plain fabrics having a grey density of 98 pcs/2.54 cm by 78 pcs/2.54 cm were obtained.

In the ordinary dyeing step, each of the resulting grey goods was subjected sequentially to relax processing (liquid stream relax processing at 110° C.), 190° C. dry heat pre-set, 130° C. continuous alkali weight loss (loss ratio 25%), 130° C. liquid stream dyeing machine and 160° C. dry heat finish set. The density of the resulting dyed fabric was 117 pcs/2.54 cm by 93 pcs/2.54 cm.

The feeling, the drape property, the functional comparative test of luster and comparison test of water absorption were conducted for these woven fabric rolls. The results were also tabulated in Table 2. In the Table, the slippery and pliable feeling, the drape property and luster were evaluated by four stages by the functional test (double circle represents especially excellent result, circle does excellent, triangle does somewhat inferior, and X does inferior).

The woven fabrics (Examples 13 to 16) obtained from the thick-and-thin combined and multi-component false-twist textured finished yarn of the present invention had a peculiar slippery and pliable feeling which was different from the feeling of the hard twist woven fabrics using the conventional round section yarns, had excellent drape property and mild luster, and were free from the wet and gooey feeling even under the water absorption state.

In contrast, the comparative product (Comparative Example 7) had inferior feeling, its drape property was low at the number of twists of 1,500 T/M, and water absorption was also inferior.

Example 17 & Comparative Examples 8 and 9

Polyethylene terephthalate having an intrinsic viscosity of [η]=0.64 (containing 0.45 wt % of titanium oxide) was spun at a rate of 3,000 m/min by using a spinneret having 24 round holes and 24 six-lobed holes as the sectional shape having the recesses as shown in FIG. 20, and a semi-drawn yarn having a size of 261 Deniers and 48 filaments was obtained (Example 17).

For comparison, the same polyethylene terephthalate as described above was spun and paralleled by the ordinary melt-spinning method at a rate of 3,000 m/min by the process shown in FIG. 18 by using a spinneret having only 24 four-lobed holes (Comparative Example 8) and a spinneret having only 24 eight-lobed holes (Comparative Example 9), and a semi-drawn yarn having a size of 270 Deniers and 48 filaments was obtained, respectively.

Next, each of the resulting semi-drawn yarns was draw and false twisted by the ordinary circumscription friction type draw/false twister to obtain the false-twist textured finished yarns.

Subsequently, the false-twist textured finished yarns were woven into woven fabrics by the ordinary weaving process. When the yarns were woven, they were wound back to 1 kg bobbin pirns at a yarn rate of 450 m/min by a pirn winder, a product of Murata Kikai K.K., and additional twist of 1,000 T/M (S twist) was applied by double twister #308, a product of Murata Kikai K.K.

The additional twisted yarn so obtained and the false-twist textured finished yarns (without additional twist) were prepared as the wefts for woven fabrics. The same yarn as the warps of Example 2 was used as the warps, and the yarns were applied to a water jet loom Model LW-52, a product of Nissan K.K. The respective yarns described above were picked as the wefts at the number of revolution of the loom of 450 rpm, and plain woven fabrics having a warp density of 98 pcs/2.54 cm and a weft density of 78 pcs/2.54 cm were obtained.

In the ordinary dyeing process, each of the resulting grey goods was subjected sequentially to liquid stream relax processing by hot water of 110° C., 190° C. dry heat pre-set, 130° C. wet heat continuous weight alkali loss (loss ratio 25%), 130° C. liquid stream dyeing machine and 160° C. dry heat finish set. The resulting dyed fabrics had substantially a warp density of 117 pcs/2.54 cm and a weft density of 93 pcs/2.54 cm.

The feeling of the resulting woven fabrics, the functional test of the drape property and water absorption evaluation were carried out. The results were tabulated in Table 3.

TABLE 1

| | Ex. 6 | Ex. 7 | Ex. 8 | Ex. 9 | Ex. 10 | Ex. 11 | Comp. Ex. 5 | Comp. Ex. 6 |
|---|---|---|---|---|---|---|---|---|
| yarn structure | | | | | | | | |
| no recess sectional shape | round | round | round | round | round | round | round/round | round/triangle |
| with recess sectional shape | 3-lobed | 4-lobed | 5-lobed | 6-lobed | 8-lobed | 6-lobed | — | — |
| mix-texturing | spun yarn paralleling | spun yarn paralleling | spun yarn paralleling | spun yarn paralleling | spun yarn paralleling | spin-die | spun yarn paralleling | spun yarn paralleling |
| with recess degree of lobar of semi-drawn yarn | 10.1 | 24.3 | 28.3 | 21.8 | 12.6 | 22.4 | — | — |
| yarn characteristics | | | | | | | | |
| size (D) | 152.6 | 152.9 | 152.6 | 152.4 | 152.7 | 152.0 | 152.6 | 152.6 |
| strength (g/d) | 4.0 | 3.7 | 3.9 | 4.0 | 4.1 | 3.9 | 4.2 | 4.1 |
| elongation (%) | 29.7 | 22.6 | 26.5 | 28.5 | 29.1 | 25.4 | 34.5 | 30.8 |
| boiling water characteristics (%) | 8.4 | 8.7 | 8.6 | 8.7 | 8.8 | 9.0 | 8.3 | 8.6 |
| CR (%) | 25.4 | 24.2 | 24.4 | 24.7 | 25.0 | 25.8 | 25.1 | 25.4 |
| TR (%) | 3.7 | 3.1 | 3.1 | 3.1 | 3.1 | 3.0 | 3.7 | 3.7 |

TABLE 1-continued

| | Ex. 6 | Ex. 7 | Ex. 8 | Ex. 9 | Ex. 10 | Ex. 11 | Comp. Ex. 5 | Comp. Ex. 6 |
|---|---|---|---|---|---|---|---|---|
| degree of interlace entanglement (pcs/m) | 238 | 259 | 259 | 235 | 261 | 249 | 264 | 241 |
| woven fabric characteristics | | | | | | | | |
| slippery and pliable feeling | | | | | | | | |
| additional twist, nil | ○ | ○ | ○ | ○ | ○ | ○ | X | X |
| No. of additional twists, 300 T/M | ○ | ○ | ○ | ○ | ○ | ○ | X | X |
| No. of additional twists, 1500 T/M | ◎ | ◎ | ◎ | ◎ | ○ | ○ | Δ | Δ |
| drape property | | | | | | | | |
| additional twist, nil | Δ | Δ | Δ | Δ | Δ | Δ | Δ | Δ |
| No. of additional twists, 300 T/M | ○ | ○ | ○ | ○ | ○ | ○ | Δ | Δ |
| No. of additional twists, 1500 T/M | ◎ | ◎ | ◎ | ◎ | ◎ | ◎ | Δ | Δ |
| luster | | | | | | | | |
| additional twist, nil | ◎ | ◎ | ◎ | ◎ | ◎ | ◎ | ○ | ○ |
| No. of additional twists, 300 T/M | ◎ | ◎ | ◎ | ◎ | ◎ | ◎ | ○ | ○ |
| No. of additional twists, 1500 T/M | ○ | ○ | ○ | ○ | ○ | ○ | X | Δ |
| water absorption (mm) | | | | | | | | |
| No. of additional twists, 300 T/M | 111 | 130 | 130 | 127 | 120 | 124 | 80 | 83 |

TABLE 2

| | Ex. 13 | Ex. 14 | Ex. 15 | Ex. 16 | Comp. Ex. 7 |
|---|---|---|---|---|---|
| yarn structure | | | | | |
| no recess sectional shape | round | round | round | round | round/ round |
| with recess sectional shape | 4-lobed | 6-lobed | 8-lobed | 6-lobed | — |
| mix-texturing | spun yarn paralleling | spun yarn paralleling | spun yarn paralleling | spin-die | spun yarn paralleling |
| with recess degree of lobar of semi-drawn yarn | 24.2 | 21.9 | 12.7 | 22.3 | — |
| yarn characteristics | | | | | |
| size (D) | 167.4 | 167.2 | 167.5 | 166.2 | 165.8 |
| strength (g/d) | 3.2 | 3.4 | 3.5 | 3.2 | 3.8 |
| elongation (%) | 26.8 | 32.9 | 33.5 | 30.0 | 33.0 |
| boiling water shrinkage ratio (%) | 7.9 | 7.8 | 7.9 | 8.0 | 8.2 |
| uster evenness U % (%) | 2.1 | 1.9 | 2.3 | 2.0 | 2.2 |
| CR (%) | 23.5 | 24.7 | 25.8 | 23.6 | 24.9 |
| TR (%) | 3.7 | 3.7 | 3.7 | 3.4 | 3.7 |
| degree of interlace entanglement (pcs/m) | 263 | 253 | 271 | 220 | 234 |
| woven fabric characteristics | | | | | |
| slippery and pliable feeling | | | | | |
| additional twist, nil | ○ | ○ | ○ | ○ | X |
| No. of additional twists, 300 T/M | ○ | ○ | ○ | ○ | X |
| No. of additional twists, 1500 T/M | ◎ | ◎ | ○ | ○ | Δ |
| drape property | | | | | |
| additional twist, nil | Δ | Δ | Δ | Δ | Δ |
| No. of additional twists, 300 T/M | ○ | ○ | ○ | ○ | Δ |
| No. of additional twists, 1500 T/M | ◎ | ◎ | ◎ | ○ | Δ |
| luster | | | | | |
| additional twist, nil | ◎ | ◎ | ◎ | ○ | ○ |
| No. of additional twists, 300 T/M | ◎ | ◎ | ◎ | ○ | ○ |
| No. of additional twists, 1500 T/M | ○ | ○ | ○ | ○ | X |
| water absorption (mm) | | | | | |
| No. of additional twists, 300 T/M | 132 | 129 | 126 | 126 | 82 |

TABLE 3

| | Ex. 17 | Comp. EX. 8 | Comp. Ex. 9 |
|---|---|---|---|
| yarn structure | | | |
| no recess sectional shape | round | — | — |
| with recess sectional shape | 6-lobed | 4-lobed | 8-lobed |
| with recess degree of lobar of semi-drawn yarn | 21.8 | 24.3 | 12.6 |
| yarn characteristics | | | |
| size (D) | 153.4 | 154.7 | 153.9 |
| strength (g/d) | 3.9 | 3.9 | 4.2 |
| elongation (%) | 25.5 | 24.0 | 27.8 |
| boiling water shrinkage ratio (%) | 9.0 | 9.1 | 8.6 |
| CR (%) | 32.9 | 29.2 | 35.9 |
| TR (%) | 3.0 | 2.8 | 3.0 |
| degree of interlace entanglement (pcs/m) | 195 | 198 | 202 |
| woven fabric characteristics | | | |
| slippery and pliable feeling | | | |
| additional twist, nil | ○ | Δ | Δ |
| No. of additional twists, 1000 T/M | ⊙ | ○ | ○ |
| drape property | | | |
| additional twist, nil | Δ | Δ | Δ |
| No. of additional twists, 1000 T/M | ⊙ | ○ | ○ |
| water absorption (mm) | | | |
| additional twist, nil | 109 | 81 | 90 |
| No. of additional twists, 1000 T/M | 118 | 81 | 101 |

We claim:

1. A combined and multi-component false-twist textured filament yarn consisting of at least two kinds of false-twist textured polyester multi-filament yarns having different sectional shapes, characterized in that at least one kind of said filament yarn has a sectional shape not having a recess and the other of said filament yarns have a sectional shape having recesses, and said filament yarns having the respective sectional shapes are dispersedly mix-textured, and have the following characteristics:

$$U\ \% \geqq 0.8 \quad (1)$$

$$\Delta Sw\ (\%) \leqq 15 \quad (2)$$

$$CR\ (\%) \leqq 42 \quad (3)$$

$$TR\ (\%) \leqq 20 \quad (4)$$

where:

U % is a uster evenness

ΔSw is a boiling water shrinkage ratio,

CR is a crimp rigidity, and

TR is a crimp appearance stretch ratio.

2. A combined and multi-component false-twist textured filament yarn according to claim 1, wherein a twist coefficient α, defined by the following formula, is within the range of 2,400 to 14,500:

$$\text{the number of twists } T_1\ (T/M) = \alpha \cdot D^{-1/2} \quad (5)$$

where:

α: twist coefficient,

D: total fiber size (Denier) of combined and multi-component false-twist textured yarn.

3. A combined and multi-component false-twist textured filament yarn consisting of at least two kinds of false-twist textured polyester multi-filament yarns having different sectional shapes which are dispersedly mix-textured, characterized in that at least one kind of single filaments have a sectional shape not having a recess, the other kinds of single filaments have a sectional shape having recesses, and when at least one kind of said single filaments having a sectional shape not having a recess and at least one kind of said single filaments having a sectional shape having recesses come into mutual contact, a gap is defined between the sectional shapes of said single filaments.

4. A combined and multi-component false-twist textured filament yarn consisting of at least two kinds of false-twist textured polyester multi-filament yarns having different sectional shapes which are dispersedly mix-textured, characterized in that at least one kind of single filaments have a sectional shape not having a recess the other kinds of single filaments have a sectional shape having recesses, when at least one kind of said single filaments having a sectional shape not having a recess and at least one kind of said single filament having a sectional shape having recesses come into mutual contact, a gap is defined between the sectional shapes of said single filaments, and a uster evenness U % is at least 0.8%.

5. A combined and multi-component false-twist textured filament yarn according to claim 3, wherein a degree of lobar of the sectional shape of said single filament having the recesses is 5 to 60.

6. A combined and multi-component false-twist textured filament yarn according to claim 3, wherein a boiling water shrinkage ratio SW (%) is from 6 to 15%, a crimp rigidity CR (%) among crimp characteristics is not greater than 35%, and a crimp appearance stretch ratio TR (%) by heat-treatment under load is not greater than 5%.

7. A combined and multi-component false-twist textured filament yarn according to claim 4, wherein a boiling water shrinkage ratio SW (%) is not greater than 15%, a crimp rigidity CR (%) among crimp characteristics is not greater than 42%, and a crimp appearance stretch ratio TR (%) by heat-treatment under load is not greater than 20%.

8. A combined and multi-component false-twist textured filament yarn according to any of claims 3, 4, 5, 6 and 7, wherein a twist coefficient α expressed by the following formula is within the range of 2,400 to 14,500:

$$\text{the number of twists } T_1\ (T/M) = \alpha \cdot D^{-1/2} \quad (9)$$

where:

α: twist coefficient

D: total fiber size (Denier) of combined and multi-component false-twist textured filament yarn.

9. A method of producing a combined and multi-component false-twist textured filament yarn comprising:

mix-texturing and bundling at least two kinds of filament yarns which are obtained by spinning a molten polyester polymer and cooling said spun polymer, at least one kind of which is a filament yarn having a sectional shape not having a recess and the other of which are filament yarns having sectional shapes having recesses, before they are taken up by a take-up roller;

taking them up at a take-up rate of not higher than 4,500 m/min to obtain polyester undrawn or semi-drawn yarns;

out-drawing said undrawn or semi-drawn yarns at a draw ratio expressed by the following formula (6) at a temperature within the range of 70° to 90° C.; and drawing and false-twist texturing said yarns with a twist coefficient α, defined by the following formula (7), within the range of 24,000 to 35,000, and at a false-twist texturing heater temperature of 110° to 190° C., so as to disperse said filament yarns having the respective sectional shapes:

$$0.70 \times NDR \leqq R \leqq 0.98 \times NDR \quad (6)$$

$$\text{twist coefficient } \alpha = T_2 \cdot D^{1/2} \quad (7)$$

where:

NDR: natural draw ratio of polyester undrawn or semi-drawn yarn,

R: out-draw draw ratio, $T_2$: the number of false twists (T/M),

D: total fiber size (Denier) of combined and multi-component false-twist textured yarn.

10. A method of producing a combined and multi-component false-twist textured filament yarn according to claim 9, wherein said molten polyester polymer is spun from a spinneret consisting of at least two kinds of spinning holes having mutually different shapes, at least one kind of said spinning holes having a shape not having a recess and the other having shapes having recesses.

11. A method of producing a combined and multi-component false-twist textured filament yarn according to claim 9 or 10, wherein an entanglement processing having a degree of entanglement of at least 10 pcs/m is carried out by using an interlace nozzle after said draw and false-twist texturing processing is effected.

12. A knitted/woven fabric obtained from combined and multi-component false-twist textured yarns comprising polyester multi-filament yarns consisting of at least two kinds of false-twist textured filament yarns having different sectional shapes, characterized in that at least one kind of said filament yarns have a sectional shape not having a recess, the other of said filament yarns have sectional shapes having recesses, said filament yarns having the respective sectional shapes are dispersedly mix-textured, a uster evenness is not smaller than 0.8%, and a twist coefficient α expressed by the following formula is within the range of 2,400 to 14,500:

$$\text{the number of twists } T_1(T/M) = \alpha \cdot D^{-1/2} \quad (8)$$

where:

α: twist coefficient,

D: total fiber size (Denier) of said combined and multi-component false-twist textured filament yarn.

13. A knitted/woven fabric according to claim 12, wherein crimp characteristics of said combined and multi-component false-twist textured filament yarn before additional twist is such that a boiling water shrinkage ratio SW (%) is not greater than 15%, a crimp rigidity CR (%) among crimp characteristics is not greater than 42%, and a crimp appearance stretch ratio TR (%) by heat-treatment under load is not greater than 20%.

14. A knitted/woven fabric obtained from a combined and multi-component false-twist textured filament yarn consisting of at least two kinds of false-twist textured polyester multi-filament yarn having different sectional shapes which are dispersedly mix-textured, characterized in that at least one kind of single filaments have a sectional shape not having a recess and the other kind of said single filaments have a sectional shape having recesses, when at least one kind of said single filaments having a sectional shape not having a recess and at least one kind of said single filaments having a sectional shape having recesses come into mutual contact, a gap is defined between the sectional shapes of said single filaments, and a twist coefficient α, defined by the following formula, is within the range of 2,400 to 14,500:

$$\text{the number of twists } T_1(T/M) = \alpha \cdot D^{-1/2} \quad (10)$$

where:

α: twist coefficient,

D: total fiber size (Denier) of combined and multi-component false-twist textured yarn.

15. A knitted/woven fabric according to claim 14, wherein crimp characteristics of said combined and multi-component false-twist textured yarn before additional twist are such that a boiling water shrinkage ratio SW (%) is from 6 to 15%, a crimp rigidity CR (%) among the crimp characteristics is not greater than 35%, and a crimp appearance stretch ratio TR (%) by heat-treatment under load is not greater than 5%.

16. A knitted/woven fabric obtained from a combined and multi-component false-twist textured filament yarn consisting of at least two kinds of false-twist textured polyester multi-filament yarns having different sectional shapes which are dispersedly mix-textured, characterized in that at least one kind of single filaments have a sectional shape not having a recess and the other kinds of said single filaments have a sectional shape having recesses, when at least one kind of said single filaments having a sectional shape not having a recess and at least one kind of said single filaments having a sectional shape having recesses come into mutual contact, a gap is defined between the sectional shapes of said single filaments, a uster evenness U % is at least 0.8%, and a twist coefficient α, defined by the following formula, is within the range of 2,400 to 14,500:

$$\text{the number of twists } T_1(T/M) = \alpha \cdot D^{-1/2} \quad (11)$$

where:

α: twist coefficient,

D: total fiber size (Denier) of combined and multi-component false-twist textured filament yarn.

17. A knitted/woven fabric according to claim 16, wherein crimp characteristics of said combined and multi-component false-twist textured yarn before additional twist are such that a boiling water shrinkage ratio SW (%) is not greater than 15%, a crimp rigidity CR (%) among said crimp characteristics is not greater than 42%, and a crimp appearance stretch ratio TR (%) by heat-treatment under load is not greater than 20%.

18. A knitted/woven fabric according to claim 14 or 16, which is subjected to hydrophilic treatment.

* * * * *